US010451253B2

(12) United States Patent
Li et al.

(10) Patent No.: US 10,451,253 B2
(45) Date of Patent: Oct. 22, 2019

(54) TROFFER-STYLE FIXTURE WITH LED STRIPS

(71) Applicant: CREE HONG KONG LIMITED, Shatin, New Territories (HK)

(72) Inventors: Chi Man Chris Li, N.T. (HK); Chi Hoi Felix Mung, Kowloon (HK); Ho Ching Gauss So, Kowloon (HK); Wai To Yan, N.T. (HK)

(73) Assignee: IDEAL Industries Lighting LLC, Sycamore, IL (US)

( * ) Notice: Subject to any disclaimer, the term of this patent is extended or adjusted under 35 U.S.C. 154(b) by 0 days.

(21) Appl. No.: 14/170,627

(22) Filed: Feb. 2, 2014

(65) Prior Publication Data

US 2015/0219319 A1 Aug. 6, 2015

(51) Int. Cl.

| | |
|---|---|
| ***F21V 1/00*** | (2006.01) |
| ***F21V 17/10*** | (2006.01) |
| ***F21V 23/02*** | (2006.01) |
| ***F21S 8/04*** | (2006.01) |
| ***F21V 23/00*** | (2015.01) |
| ***F21V 29/507*** | (2015.01) |

(Continued)

(52) U.S. Cl.

CPC ..... *F21V 17/10* (2013.01); *F21S 8/04* (2013.01); *F21V 23/008* (2013.01); *F21V 23/023* (2013.01); *F21V 29/507* (2015.01); *F21V 3/062* (2018.02); *F21V 19/003* (2013.01); *F21Y 2105/10* (2016.08); *F21Y 2115/10* (2016.08); *Y10T 29/49826* (2015.01)

(58) Field of Classification Search

CPC .... F21V 3/0418; F21V 3/0427; F21V 3/0436; F21V 3/0445; F21V 5/008; F21V 1/24; F21V 1/04; F21V 1/14; F21V 1/16; F21V 29/773

USPC ..... 362/217.05

See application file for complete search history.

(56) References Cited

U.S. PATENT DOCUMENTS

| | | | | |
|---|---|---|---|---|
| 2,356,654 A | 8/1944 | Cullman | ..... | 200/84 C |
| 3,381,124 A | 4/1968 | Eisenberg | ..... | 362/354 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

Cree LR24 Architectural LED troffer product information, 2 pages, available at www.cree.com/lighting.

(Continued)

*Primary Examiner* — Matthew J. Peerce

(74) *Attorney, Agent, or Firm* — Ferguson Case Orr Paterson LLP

(57) ABSTRACT

The present invention relates to different embodiments of lighting fixtures, such as troffers. A lens can be placed between a light engine and a reflector and secured in place by crimping portions of the light engine, reflector, or both to prevent the lens from moving. Troffers according to the present invention can lack a dedicated heat sink, instead sufficiently dissipating heat through the light engine. This can significantly reduce the weight of the troffer. Emitter panels can be directly mounted on a light engine inner surface, or on an internal reflector within the light engine.

27 Claims, 38 Drawing Sheets

(51) Int. Cl.

| | |
|---|---|
| *F21V 3/06* | (2018.01) |
| *F21V 19/00* | (2006.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 3,743,826 | A | 7/1973 | Halfaker | |
| 3,790,774 | A | 2/1974 | Miller | |
| 4,939,627 | A | 7/1990 | Herst et al. | 362/299 |
| 5,025,356 | A | 6/1991 | Gawad | 362/221 |
| 5,222,800 | A * | 6/1993 | Chan | F21S 8/02 362/147 |
| 5,526,190 | A | 6/1996 | Hubble, III et al. | 347/102 |
| 6,079,851 | A | 6/2000 | Altman | |
| 6,102,550 | A | 8/2000 | Edwards, Jr. | |
| 6,149,283 | A | 11/2000 | Conway et al. | 362/236 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,578,979 | B2 | 6/2003 | Truttmann-Battig | 362/92 |
| 6,598,998 | B2 | 7/2003 | West | 257/E33.073 |
| D496,121 | S | 9/2004 | Santoro | D26/74 |
| 6,871,983 | B2 | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,217,004 | B2 | 5/2007 | Park | 362/240 |
| 7,237,924 | B2 | 7/2007 | Martineau et al. | 362/231 |
| 7,338,182 | B1 | 3/2008 | Hastings et al. | 362/150 |
| 7,341,358 | B2 | 3/2008 | Hsieh | 362/97.1 |
| 7,520,636 | B2 | 4/2009 | Van Der Poel | 362/290 |
| 7,559,672 | B1 | 7/2009 | Parkyn et al. | 362/244 |
| 7,614,767 | B2 | 11/2009 | Zulim | |
| 7,618,157 | B1 | 11/2009 | Galvez et al. | 362/294 |
| 7,618,160 | B2 | 11/2009 | Chinniah et al. | 362/326 |
| 7,654,688 | B2 | 2/2010 | Li | |
| 7,654,702 | B1 | 2/2010 | Ding et al. | 362/294 |
| 7,674,005 | B2 | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,722,220 | B2 | 5/2010 | Van De Ven | 362/294 |
| 7,722,227 | B2 | 5/2010 | Zhang et al. | 362/364 |
| 7,824,056 | B2 | 11/2010 | Madireddi et al. | 362/125 |
| 7,828,468 | B2 | 11/2010 | Mayfield et al. | 362/342 |
| 7,868,484 | B2 | 1/2011 | Groff et al. | 362/375 |
| 7,922,354 | B2 | 4/2011 | Everhart | 362/235 |
| 7,926,982 | B2 | 4/2011 | Liu | 362/294 |
| 7,959,332 | B2 | 6/2011 | Tickner | |
| 7,988,321 | B2 | 8/2011 | Wung et al. | 362/218 |
| 7,988,335 | B2 | 8/2011 | Liu et al. | 362/294 |
| 7,991,257 | B1 | 8/2011 | Coleman | 264/1.24 |
| 7,993,034 | B2 | 8/2011 | Wegner | 362/296.05 |
| 7,997,762 | B2 | 8/2011 | Wang et al. | 362/249 |
| 8,038,314 | B2 | 10/2011 | Ladewig | |
| 8,038,321 | B1 | 10/2011 | Franck et al. | 362/249.02 |
| 8,070,326 | B2 | 12/2011 | Lee | 362/307 |
| 8,092,043 | B2 | 1/2012 | Lin et al. | 362/249.02 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,215,799 | B2 | 7/2012 | Vanden Eynden et al. | 362/294 |
| 8,246,219 | B2 | 8/2012 | Teng | 362/217.02 |
| 8,256,927 | B2 | 9/2012 | Hu et al. | 362/218 |
| 8,287,160 | B2 | 10/2012 | Shen | |
| D670,849 | S | 11/2012 | Lay et al. | D26/74 |
| 8,317,354 | B2 | 11/2012 | Gassner et al. | 362/147 |
| D676,848 | S | 4/2013 | Pickard | D26/74 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,523,383 | B1 | 9/2013 | Grigore | |
| 8,556,452 | B2 | 10/2013 | Simon | 362/217.07 |
| 8,591,058 | B2 | 11/2013 | Concepcion | 362/231 |
| 8,591,071 | B2 | 11/2013 | Hochstein | 362/294 |
| 8,602,601 | B2 * | 12/2013 | Khazi | F21S 8/026 362/249.02 |
| 8,616,723 | B2 | 12/2013 | Zhang | 362/218 |
| D698,975 | S | 2/2014 | Blessitt et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 * | 7/2014 | Jeon | F21K 9/30 362/218 |
| D714,988 | S | 10/2014 | Park et al. | D26/74 |
| D721,198 | S | 1/2015 | Glasbrenner | D26/76 |
| 9,010,956 | B1 | 4/2015 | Davis | |
| 9,052,075 | B2 | 6/2015 | Demuynck et al. | |
| 2003/0063476 | A1 | 4/2003 | English et al. | |
| 2004/0001344 | A1 | 1/2004 | Hecht | 365/555 |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |
| 2005/0281023 | A1 * | 12/2005 | Gould | F21S 8/04 362/217.05 |
| 2006/0221611 | A1 | 10/2006 | Noh | 362/247 |
| 2006/0245208 | A1 | 11/2006 | Sakamoto | |
| 2006/0262521 | A1 | 11/2006 | Piepgras et al. | 362/149 |
| 2006/0279671 | A1 | 12/2006 | Han | |
| 2006/0291206 | A1 | 12/2006 | Angelini et al. | 362/244 |
| 2007/0070625 | A1 | 3/2007 | Bang | 362/240 |
| 2007/0253205 | A1 | 11/2007 | Welker | 362/373 |
| 2007/0279910 | A1 | 12/2007 | Lin | |
| 2007/0297181 | A1 | 12/2007 | Mayfield et al. | 362/342 |
| 2008/0019147 | A1 | 1/2008 | Erchak | 362/607 |
| 2008/0037284 | A1 | 2/2008 | Rudisill | 362/629 |
| 2008/0049422 | A1 | 2/2008 | Trenchard et al. | 362/238 |
| 2008/0232093 | A1 | 9/2008 | Kim | 362/147 |
| 2008/0278943 | A1 | 11/2008 | Van Der Poel | 362/240 |
| 2008/0303977 | A1 | 12/2008 | Sekiguchi | |
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2010/0039579 | A1 | 2/2010 | Park | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van De Ven et al. | 362/294 |
| 2010/0142202 | A1 | 6/2010 | Sugishita | |
| 2010/0177514 | A1 | 7/2010 | Liu | |
| 2010/0177532 | A1 | 7/2010 | Simon et al. | |
| 2010/0226139 | A1 * | 9/2010 | Lynch | F21S 8/02 362/373 |
| 2010/0253591 | A1 | 10/2010 | Hwu et al. | 345/1.3 |
| 2010/0254128 | A1 | 10/2010 | Pickard et al. | 362/231 |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1 | 7/2011 | Huang | 362/235 |

(56) References Cited

U.S. PATENT DOCUMENTS

| | | | | |
|---|---|---|---|---|
| 2011/0175533 | A1 | 7/2011 | Holman | 315/130 |
| 2011/0222291 | A1 | 9/2011 | Peng | |
| 2011/0246146 | A1 | 10/2011 | Kauffman et al. | 703/2 |
| 2011/0255292 | A1* | 10/2011 | Shen | F21V 15/01 362/311.02 |
| 2011/0267810 | A1 | 11/2011 | Higman et al. | 362/218 |
| 2011/0267823 | A1 | 11/2011 | Angelini et al. | 362/277 |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0134146 | A1 | 5/2012 | Smith | 362/225 |
| 2012/0140442 | A1* | 6/2012 | Woo | F21K 9/30 362/95 |
| 2012/0206926 | A9 | 8/2012 | Chou | |
| 2012/0320576 | A1 | 12/2012 | Wald | |
| 2013/0235568 | A1 | 9/2013 | Green et al. | 362/218 |
| 2013/0242550 | A1 | 9/2013 | Suen | |
| 2013/0258652 | A1* | 10/2013 | Hsieh | F21V 7/0033 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| DE | 102007030186 | | 1/2009 |
| DE | 102007030186 | A1 | 1/2009 |
| EP | 1298383 | | 4/2003 |
| EP | 1298383 | A2 | 4/2003 |
| EP | 1847762 | | 10/2007 |
| EP | 1847762 | A2 | 10/2007 |
| EP | 2287520 | A2 | 2/2011 |
| EP | 2290690 | A2 | 3/2011 |
| EP | 2636945 | A2 | 11/2013 |
| GB | 774198 | | 5/1957 |
| JP | 1069809 | | 3/1998 |
| JP | 03097327 | | 8/2003 |
| JP | 2004345615 | | 12/2004 |
| JP | 2004345615 | A | 12/2004 |
| JP | 2006173624 | | 6/2006 |
| JP | 2008147044 | | 8/2008 |
| JP | 3151501 | U | 6/2009 |
| JP | 2009295577 | | 12/2009 |
| JP | 2010103687 | | 5/2010 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| TW | WO 2010024583 | A2 | 5/2010 |
| WO | WO 2009030233 | | 3/2009 |
| WO | WO 2009157999 | | 12/2009 |
| WO | WO 2009157999 | A2 | 3/2010 |
| WO | WO 2010024583 | | 3/2010 |
| WO | WO 2010042216 | | 4/2010 |
| WO | WO 03102467 | | 12/2013 |

OTHER PUBLICATIONS

Office Action from U.S. Appl. No. 13/787.727, dated Jan. 29, 2015.
Office Action from U.S. Appl. No. 13/429,080, dated Feb. 18, 2015.
Office Action from U.S. Appl. No. 13/453.924, dated Mar. 10, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from Patent Application No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
International Preliminary Report on Patentabiliby from PCT/US2012/071800 dated Jul. 10, 2014.
Office Action from U.S. Appl. No. 13/169,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Office Action from U.S. Appl. No. 13/429,080, dated Apr. 18, 2014.
Office Action from U.S. Appl. No. 12/961,385, dated Mar. 11, 2014.
Office Action from U.S. Appl. No. 13/464,745, dated Jul. 16, 2014.
International Preliminary Report on Patentability and Written Opinion from PCT/US2013/021053, dated Aug. 21, 2014.
Communication from European Patent Appl. No. 13701525.1-1757, dated Sep. 26, 2014.
Preliminary Report and Written Opinion from PCT appl. No. PCT/US2012/047084, dated Feb. 6, 2014.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
First Official Action from European Patent Appl. No. 12 743 003.1-1757, dated Jan. 16, 2015.
Decision of Rejection from Japanese Appl. No. 2013-543207, dated Nov. 25, 2014.
Office Action from Mexican Appl. No. 100881, dated Nov. 28. 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,060, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.

(56) References Cited

OTHER PUBLICATIONS

Office Action from U.S. Appl. 13/368,217, dated May 13, 2015.
Office Action from U.S. Appl. No. 13/828,348, dated May 27, 2015.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; dated Jan. 6, 2016.
Office Action from U.S. Appl. No. 13/341,741; dated Jan. 8, 2016.
Office Action from U.S. Appl. No. 13/873,303; dated Feb. 2, 2016.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No 2011800588770, dated Sep. 25, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Office Action for U.S. Appl. No. 14/020,757; dated Jul. 19, 2016.
Examination Report from Taiwan Application No. 100131021; dated Jul. 21, 2016.
Office Action for U.S. Appl. No. 14/716,480; dated Aug. 26, 2016.
European Summons for Oral Proceedings for Application No. 12743003.1; dated Sep. 2, 2016.
Office Action for U.S. Appl. No. 13/464,745; dated Sep. 7, 2016.
Office Action from U.S. Appl. No. 13/464,745; dated Mar. 1, 2016.
Office Action from U.S. Appl. No. 14/716,480; dated Mar. 3, 2016.
Office Action from U.S. Appl. No. 13/368,217; dated Mar. 4, 2016.
Office Action from U.S. Appl. No. 13/189,535; dated Mar. 18, 2016.
Office Action from U.S. Appl. No. 14/020,757; dated Apr. 7, 2016.
Office Action from U.S. Appl. No. 29/466,391; dated May 10, 2016.
Second Office Action for Application No. 2011800588770; dated Mar. 29, 2016.
Office Action for U.S. Appl. No. 13/028,348; dated Jun. 2, 2016.
Notice of Reason for Rejection for Japanese Appl. No. 2013-543207; dated Jun. 24, 2016.
Office Action for Chinese Patent Application No. 2011800588770; dated Sep. 26, 2016.
Notification of Reexamination for Chinese Application No. 2011800529984; dated Oct. 10, 2016.
Office Action for U.S. Appl. No. 13/828,348; dated Oct. 17, 2016.
Office Action for European Application No. 11754767.9; dated Oct. 31, 2016.
Office Action for U.S. Appl. No. 12/873,303; dated Nov. 25, 2016.
Notice of Allowance for Taiwan Application No. 100131021; dated Nov. 28, 2016.
Office Action for U.S. Appl. No. 13/368,217; dated Jan. 3, 2017.
Office Action for U.S. Appl. No. 14/716,480; dated Feb. 14, 2017.
Foreign Office Action for Japanese Application No. 2013-543207; dated Feb. 14, 2017.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
Office Action for U.S. Appl. No. 13/443,630; dated May 18, 2017.
Office Action for U.S. Appl. No. 14/716,480; dated Jul. 5, 2017.
Office Action for U.S. Appl. No. 12/873,303; dated Aug. 9, 2017.
Office Action for U.S. Appl. No. 13/828,348; dated Sep. 1, 2017.
Office Action for U.S. Appl. No. 14/225,327; dated Oct. 2, 2017.
Office Action for U.S. Appl. No. 13/464,745; dated Dec. 11, 2017.
Office Action for U.S. Appl. No. 14/716,480; dated Jan. 17, 2018.
Office Action for U.S. Appl. No. 13/189,535; dated Oct. 30, 2017.
Office Action for U.S. Appl. No. 14/721,806; dated Nov. 1, 2017.
Office Action for U.S. Appl. No. 13/189,535; dated Apr. 5, 2018.
Office Action for U.S. Appl. No. 14/225,327; dated Apr. 19, 2018.
Office Action for U.S. Appl. No. 13/464,745; dated May 2, 2018.
Foreign Office Action for European Application No. 11754767.9; Dated May 7, 2018.
Office Action for U.S. Appl. No. 12/873,303; dated Jun. 19, 2018.
Office Action for U.S. Appl. No. 13/828,348; dated Jun. 26, 2018.
Office Action for U.S. Appl. No. 14/716,480; dated Jul. 13, 2018.
Office Action for U.S. Appl. No. 14/721,806; dated Jul. 27, 2018.

* cited by examiner

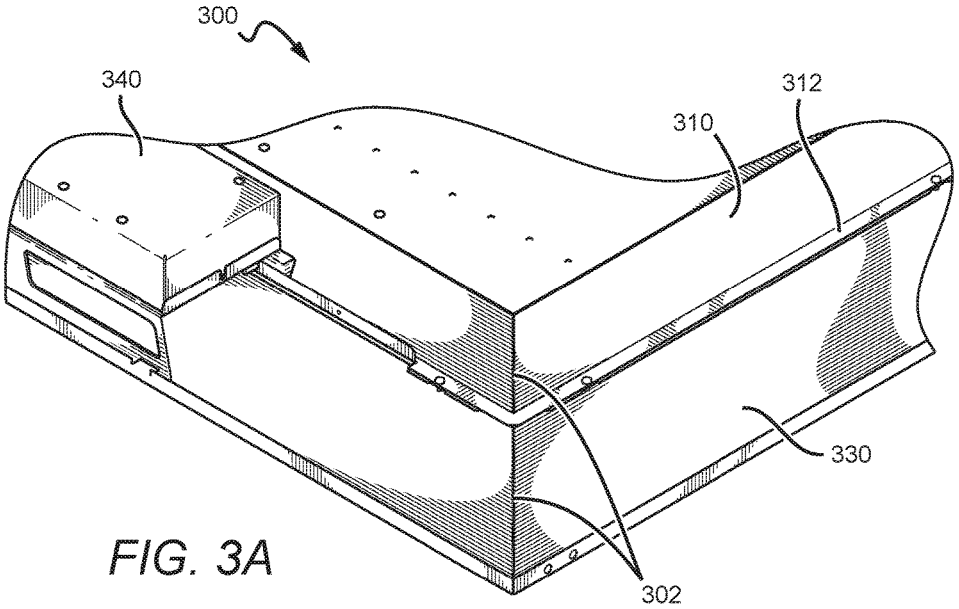
FIG. 3A
FIG. 3B
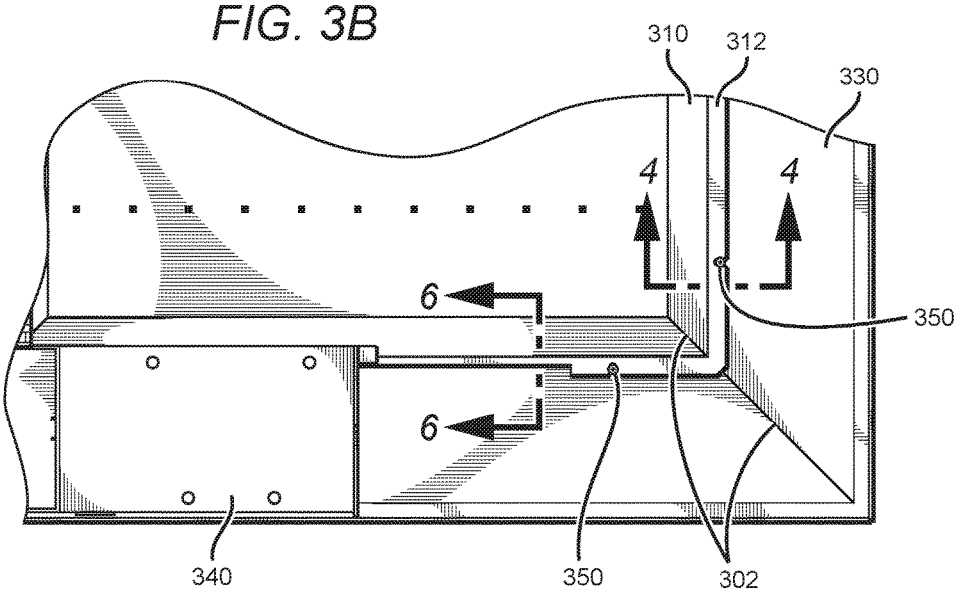

FIG. 7C
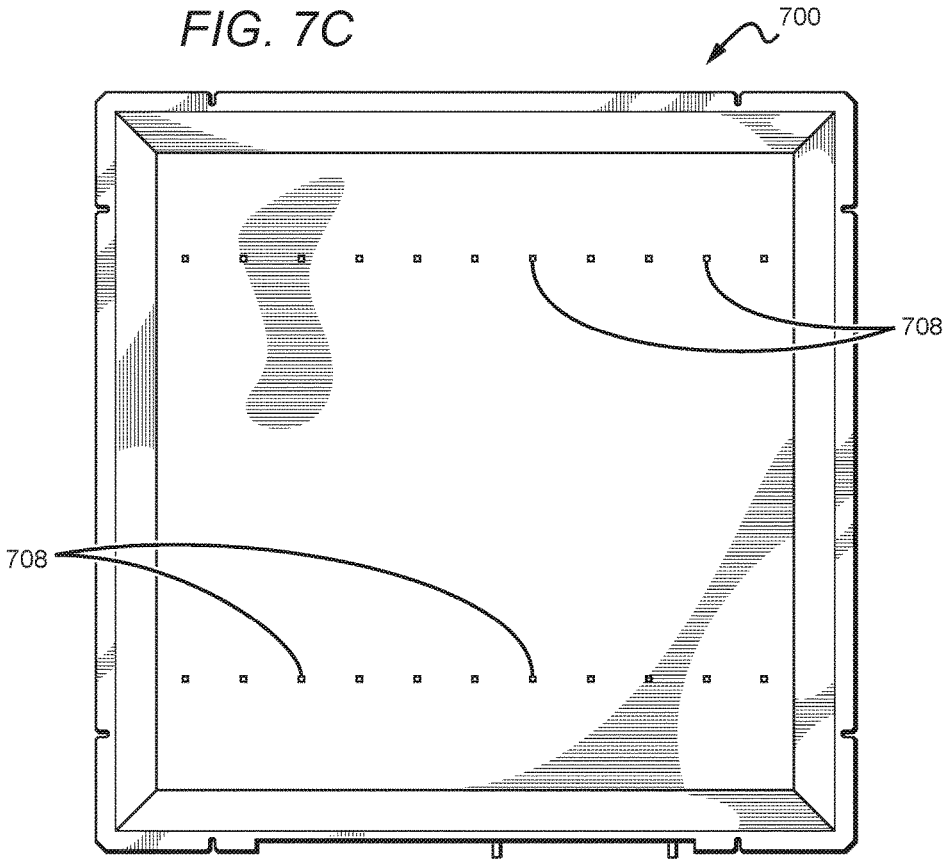
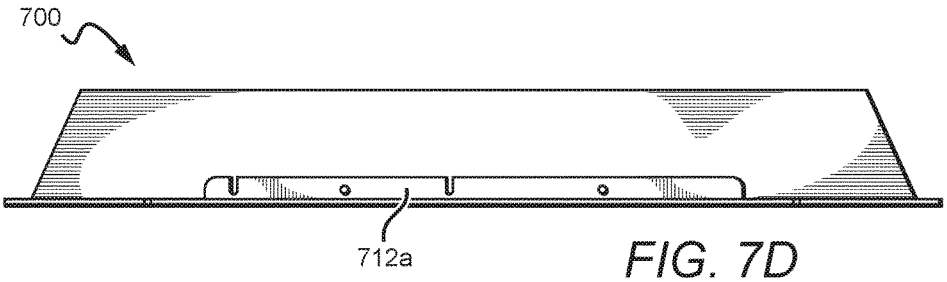
FIG. 7D
FIG. 7E
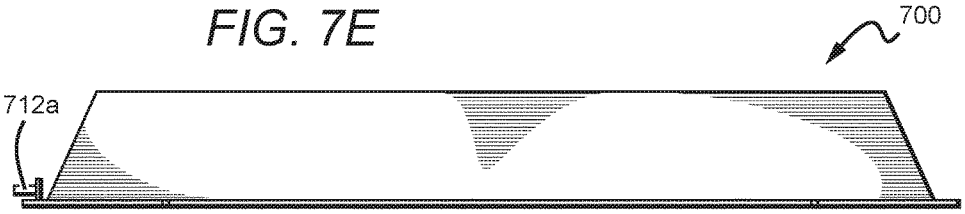

TROFFER-STYLE FIXTURE WITH LED STRIPS

BACKGROUND OF THE INVENTION

Field of the Invention

The invention relates to lighting troffers and, more particularly, to lighting troffers that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs, such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy savings.

Other LED components or lamps have been developed that comprise an array of multiple LED packages mounted to a printed circuit board (PCB), substrate or submount. The array of LED packages can comprise groups of LED packages emitting different colors, and specular or other reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices can be lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources and/or other components within the luminaire so that the individual sources are not visible to an observer. Some heavily diffusive elements have been used to mix the color spectra from the various sources to achieve a uniform output color profile. To blend the sources and aid in color mixing, these heavily diffusive exit windows have been used. However, transmission through these heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application. However, indirect lighting fixtures can have losses not associated with lighting fixtures, in that light is forced to bounce off of a reflector and no practical reflector has a reflectivity of 100%. Indeed, many indirect troffers seek to maximize the number of bounces, which can cause even further losses.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

One embodiment of a lighting fixture according to the present invention can include a light engine with one portion defining a cavity or volume and a first rim, and a reflector with a first portion and a second rim. A lens can be between the rims.

Another embodiment of a lighting fixture according to the present invention can comprise a light engine comprising a plurality of emitters on the inner surface of a shell. The lighting fixture can emit about 800 lumens per light fixture kilogram or more.

One embodiment of a light engine according to the present invention can comprise a mount surface and one or more PCB panels on the mount surface, with each of the PCB panels comprising a plurality of strips. A plurality of emitters can be on each of the strips.

One embodiment of a method according to the present invention can comprise providing a light engine with a first rim and a reflector with a second rim, and securing a lens between the rims.

One embodiment of a junction box according to the present invention can include a container portion and a rotatable cover over the container portion.

These and other aspects and advantages of the invention will become apparent to those skilled in the art from the following detailed description and the accompanying drawings, which illustrate by way of example the features of the invention.

BRIEF DESCRIPTION OF THE DRAWINGS

FIGS. 3A-3E are magnified top perspective, top, bottom, front, and side views of a corner of a troffer according to an embodiment of the present invention.

FIGS. 7A-7E are bottom perspective, top perspective, bottom, top, and side views of a light engine shell according to one embodiment of the present invention.

DETAILED DESCRIPTION OF THE INVENTION

Figure 1A:
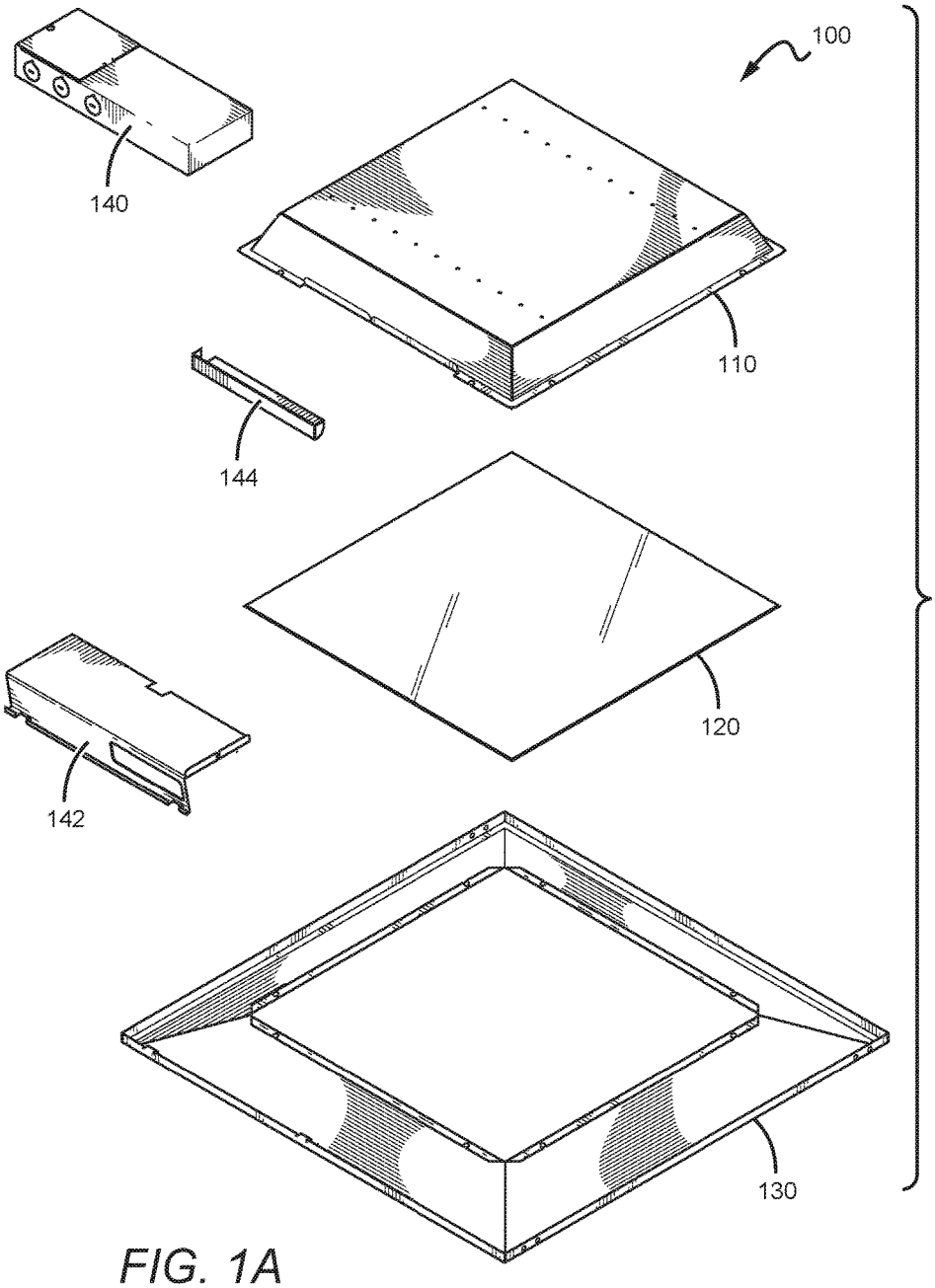
FIGS. 1A-1G are exploded top perspective, top perspective, bottom perspective, top, bottom, front, and side views of a troffer according to an embodiment of the present invention.
Figure 1B:
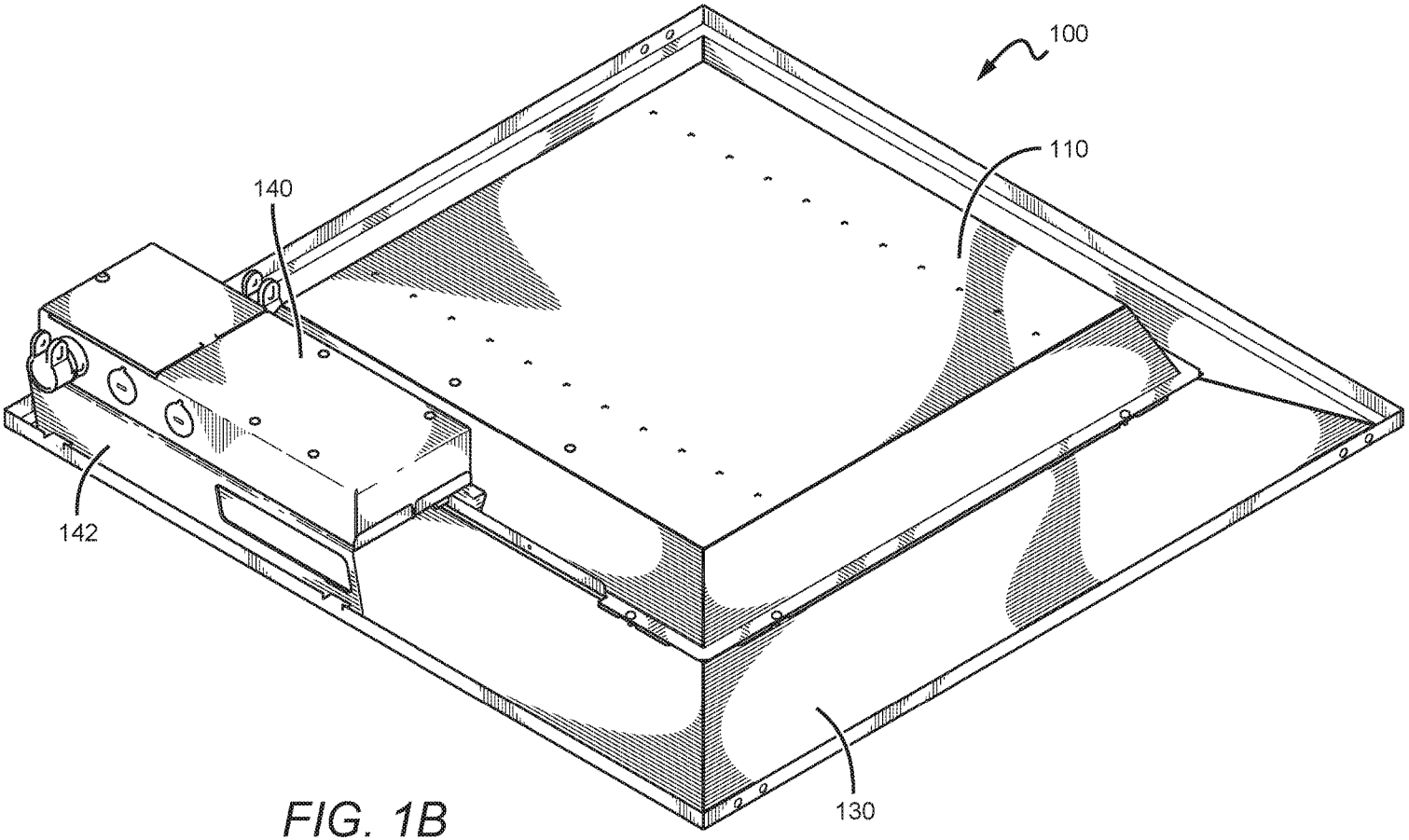
Figure 1C:
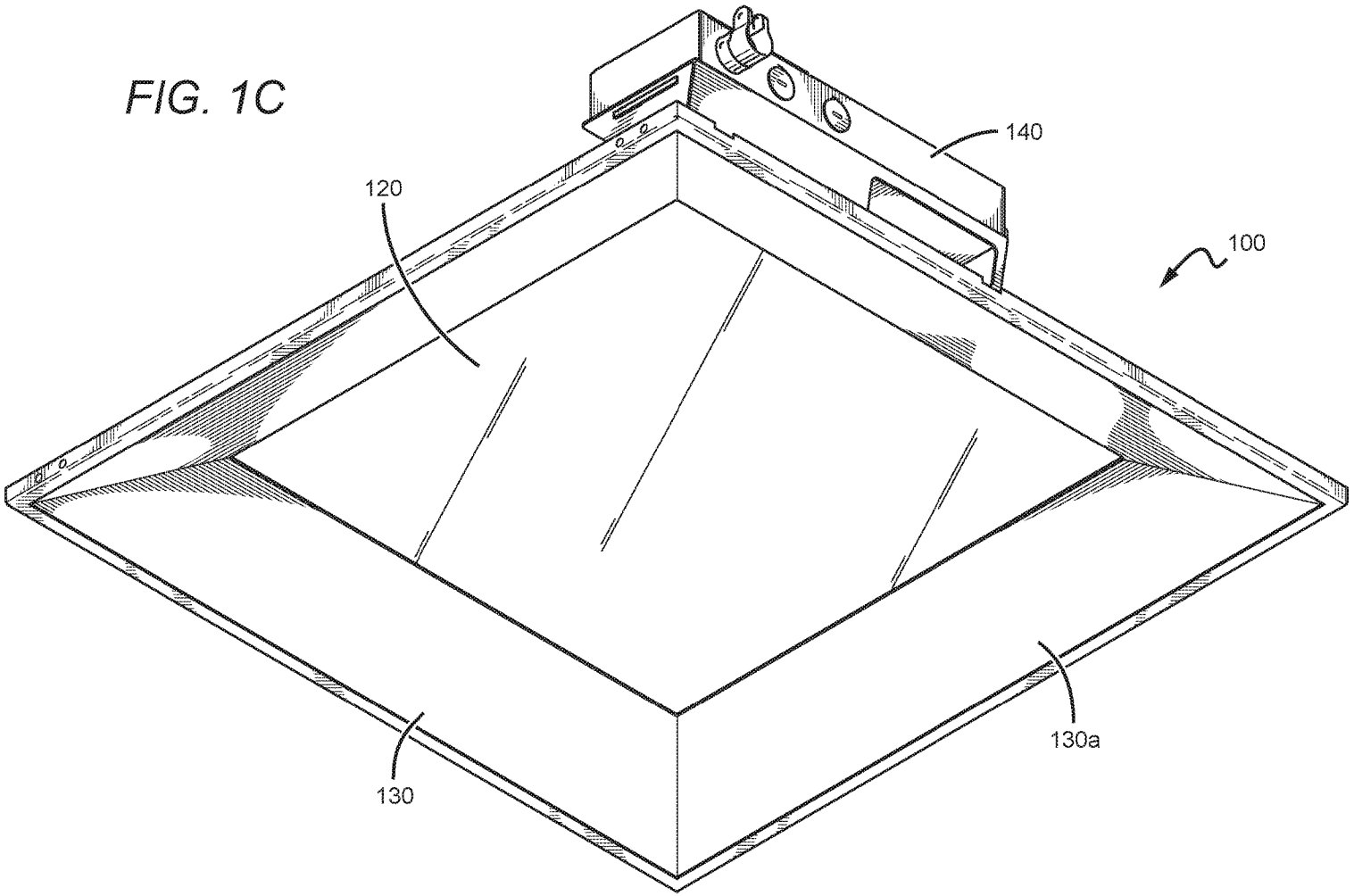

Embodiments of the present invention have similarities to embodiments described in commonly assigned application U.S. patent application Ser. No. 29/481,156 to Li et al., entitled "Troffer-Style Fixture" and filed concurrently on the same day as the present application. This application, including but not limited to the figures and descriptions thereof disclosed in this application, is fully incorporated by reference herein in its entirety.

The present invention is directed to different embodiments of lighting fixtures which can simplify fabrication, reduce weight, increase cost effectiveness, improve luminous uniformity, improve color mixing, improve output profile, and achieve many other improved characteristics. One feature to provide such an improvement can be the manner in which a lens is held in place. A lens can be placed between a light engine above the lens and a reflector below the lens. Instead of using dedicated connectors, such as screws, to connect the lens to one or both of these components, in one embodiment a rim of the light engine, the reflector, or both can be folded over or crimped so as to cover the outside edge of the lens. In one embodiment, the crimped portion can touch the non-crimped element and/or the outer edge of the lens. One or more crimped portions can be included on each side of the lens, thus securing the lens in place. In one embodiment, no connector is visible from a bottom view. This can allow for the use of a solid lens without any holes or connection areas, which can greatly reduce cost.

Another improved feature of the present invention is that no dedicated heat sink is needed to achieve a desired luminous intensity. By, for example, mounting PCB panels with emitters mounted thereon either directly onto a light engine shell or directly onto an internal reflector within the light engine shell, enough heat can be dissipated through the shell and into the ambient such that no dedicated heat sink is necessary. Other factors that can reduce the need for a dedicated heat sink include operating the emitters at a relatively low drive current, such as 100 mA or below or 25% of maximum or below, spacing the emitters to achieve a desired output profile without producing excessive heat, and placing the power supply or junction box in a manner so as to avoid sharing of thermal dissipation paths, such as by placing the junction box on a side surface of the fixture. Through one or more of these design improvements or other design improvements described herein, a dedicated heat sink can be eliminated from the design. This can greatly reduce the cost, weight, and height of a fixture.

Yet another improved aspect of fixtures according to the present invention involves the use of E-shaped PCB panels as a light source. Use of these panel shapes can save materials during device fabrication by making use of portions previously discarded. Strips of PCB can include emitters arranged, for example, in a linear array. Normally, strips of PCB would include emitters (such as those in a linear array) connected in series. However, in embodiments of the present invention the PCB can be customized to provide different types of connections between emitters. This can allow for different emitters on a strip to receive different currents, thus allowing the designer to tailor the troffer output profile.

Yet another improved aspect of fixtures according to the present invention involves a unique junction box ("j-box") design. Note that the terms power supply and j-box are used interchangeably herein, and can comprise one or both of a power supply and a j-box. The j-box can be mounted to the outside of a light engine, reflector or both. One such j-box includes a flip-top cover enabled by the use of slots and/or dowels, which can form a hinge. Different sections within the j-box can be separated from one another, such as for compliance reasons. Drive electronics can be mounted to the bottom of the j-box, or alternatively can be mounted to the bottom surface of the top cover. This can allow for easy access to different drive electronics, such as AC drive electronics and dimmer drive electronics, which can be in different sections of the j-box.

Embodiments of the present invention are described herein with reference to conversion materials, wavelength conversion materials, phosphors, phosphor layers and related terms. The use of these terms should not be construed as limiting. It is understood that the use of the term phosphor, or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIGS. 1A-1G are views of a troffer 100 according to one embodiment of the present invention. The troffer can include a light engine 110, a lens 120, a reflector 130, and a junction box (or "j-box") 140, each of which will be discussed in detail below. The troffer 100 can have a square bottom-side footprint with the square lens 110 at its center. It is understood that the troffer 100 and/or lens 120 can easily be adapted to have a footprint of other shapes, including but not limited to a rectangular shape. The lens can be attached to the light engine 110, reflector 130, or both; many different lens attachment configurations are possible, some of which will be discussed below. Similarly, the j-box 140 can be attached to the outside of the light engine 110, the reflector 130, or both. In the embodiment shown, the j-box 140 can be attached to the side of the light engine 110 and/or can be supported by a prop or support 142 which can be attached to the reflector 130. The reflector 130 can have an inner surface **130*a*** which can be used to reflect light from emitters.

Lenses can cover varying percentages of the bottom side visible surface of troffers according to the present invention. As best seen in FIG. 1E, the lens 120 can cover approximately ⅔ or more of the bottom side visible surface of the troffer 100, or in different terms the troffer 100 can have a luminous area ratio of about ⅔ or more. In certain applications, a higher luminous area ratio can be desirable, while in other applications a fixture having a lower luminous area ratio can be used provided it achieves the desired emission; such a fixture can have lower overall cost due in part to the size of the lens to be used. One manner in which the luminous area ratio can be adjusted is to adjust the ratio of the height of the light engine to the height of the reflector. Because a lens is between these two elements, typically if the reflector is shorter the luminous area can be higher, since a lens can be closer to the bottom of the fixture. The troffer 100 can have a light engine height to reflector height ratio of about 4:3, although larger and smaller ratios are possible. Fixtures according to the present invention, and specifically troffers comprising lenses according to the present invention, can be designed to achieve a panel-like effect.

Figure 1D:
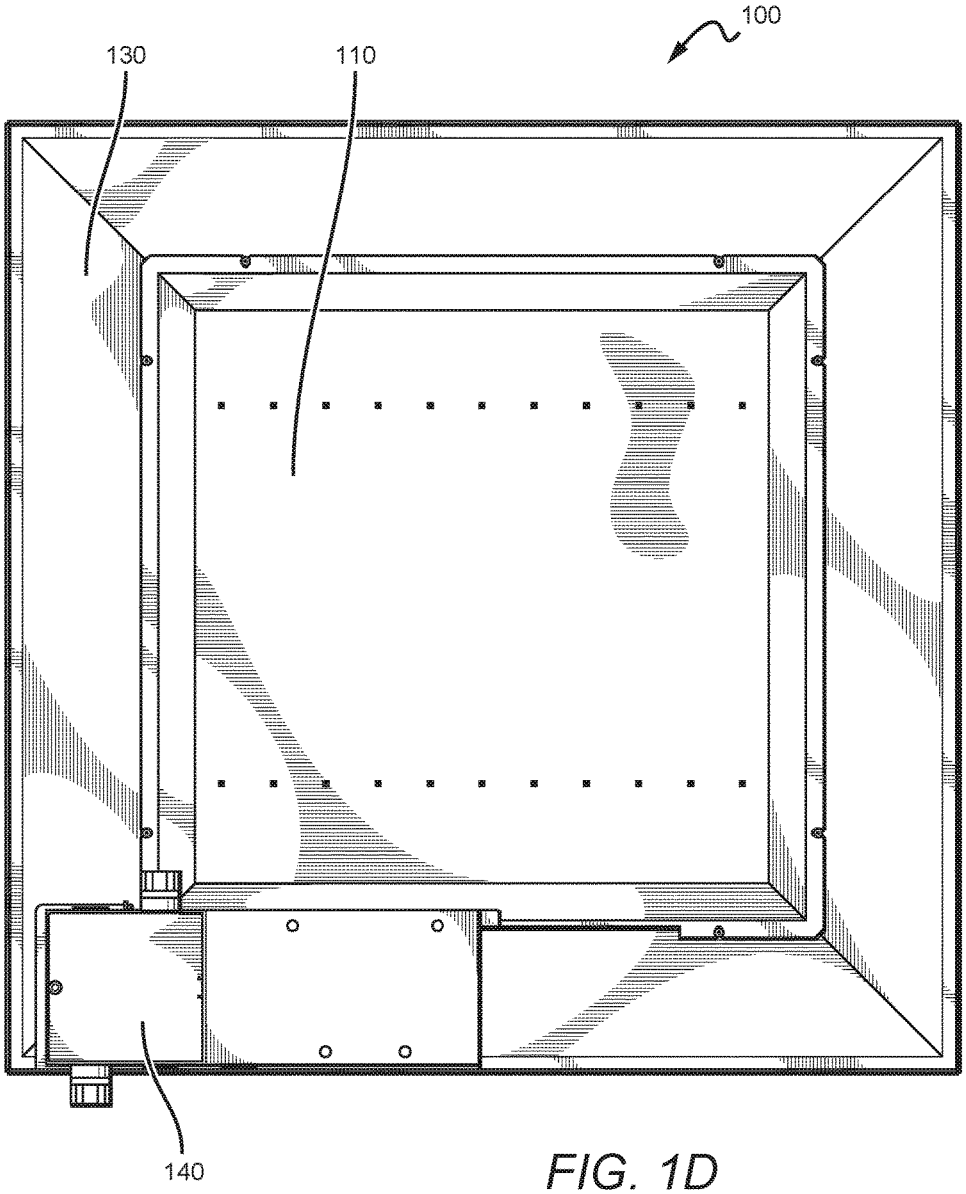
Figure 1E:
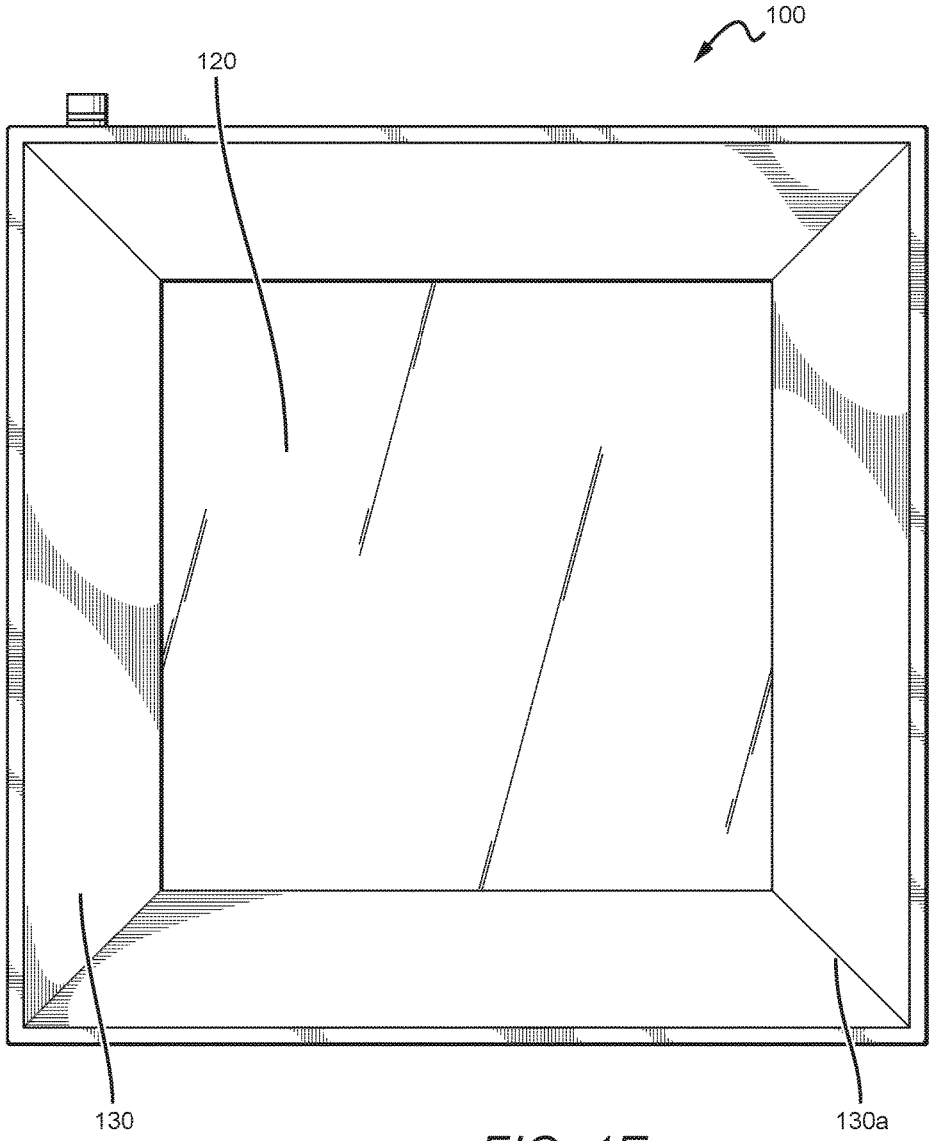
Figure 1F:
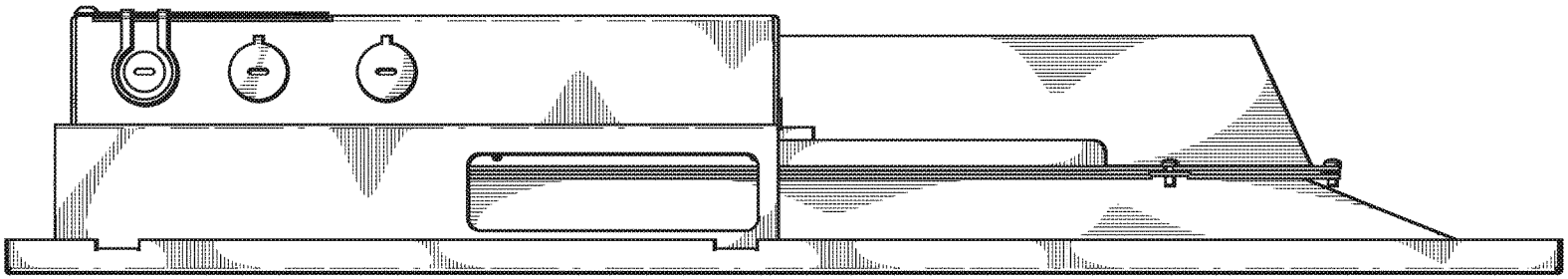
Figure 1G:
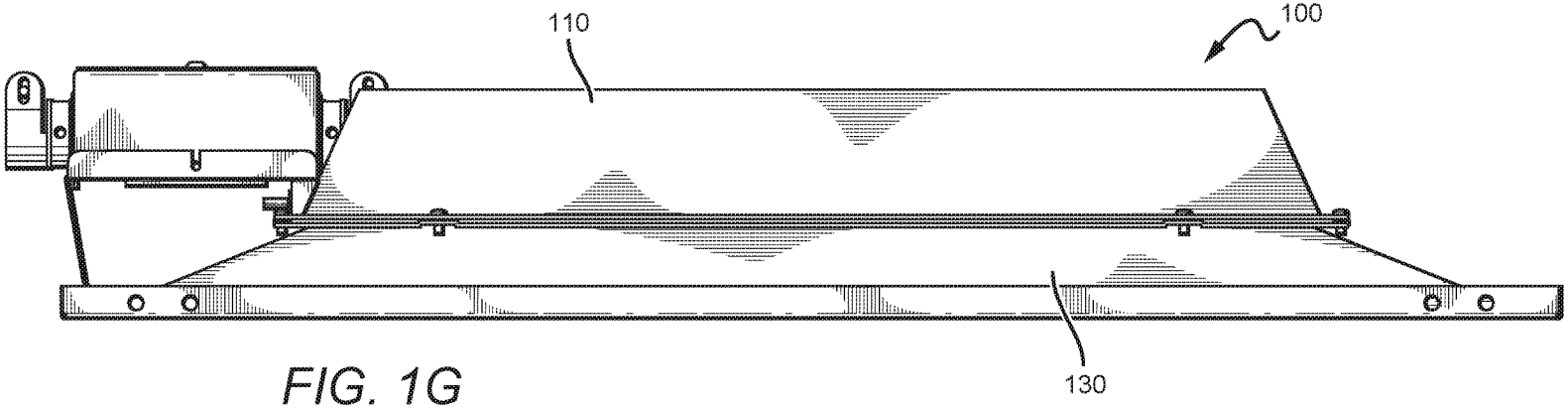
Figure 2A:
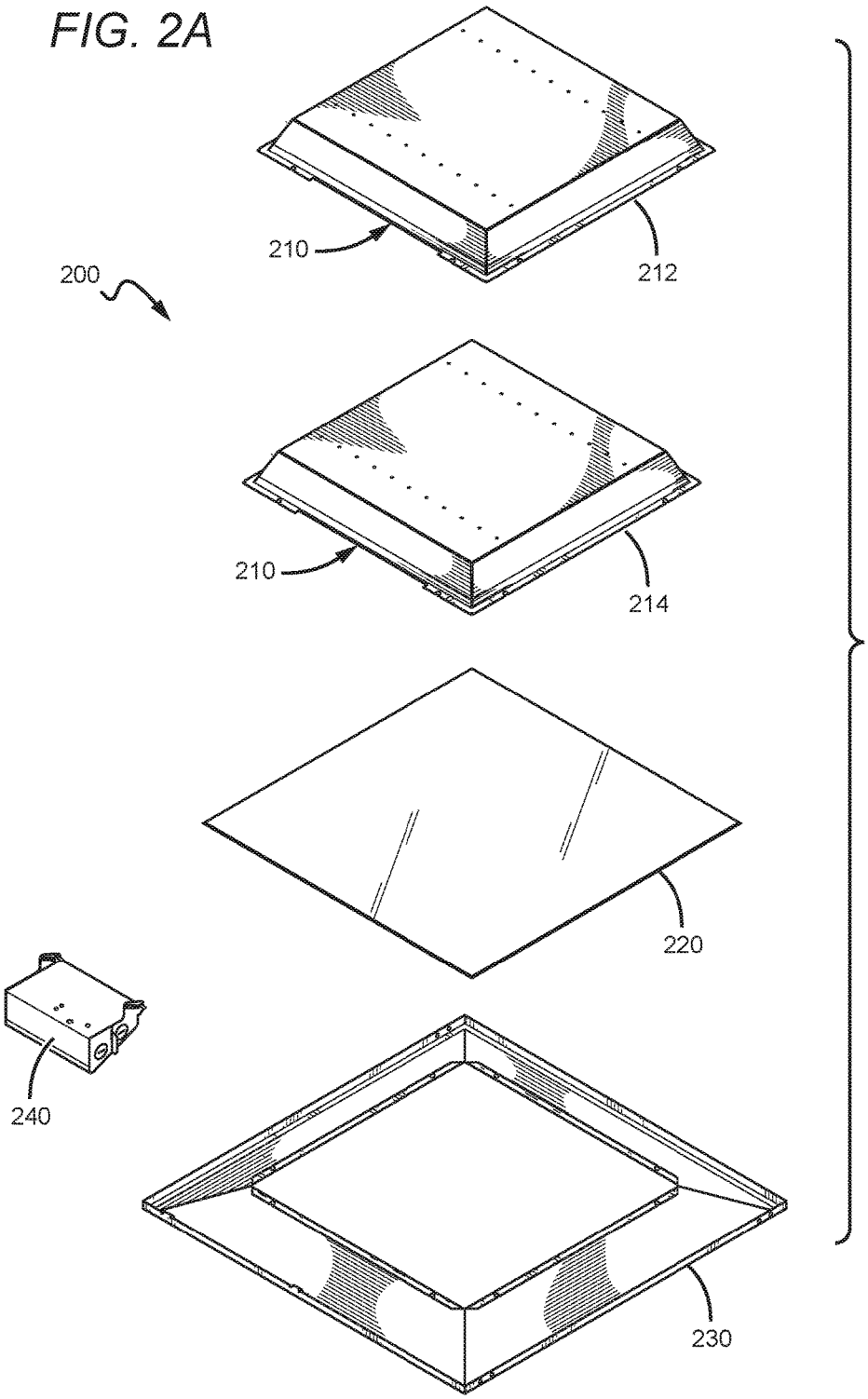
FIGS. 2A-2G are exploded top perspective, top perspective, bottom perspective, top, bottom, front, and side views of a troffer according to another embodiment of the present invention.
Figure 2B:
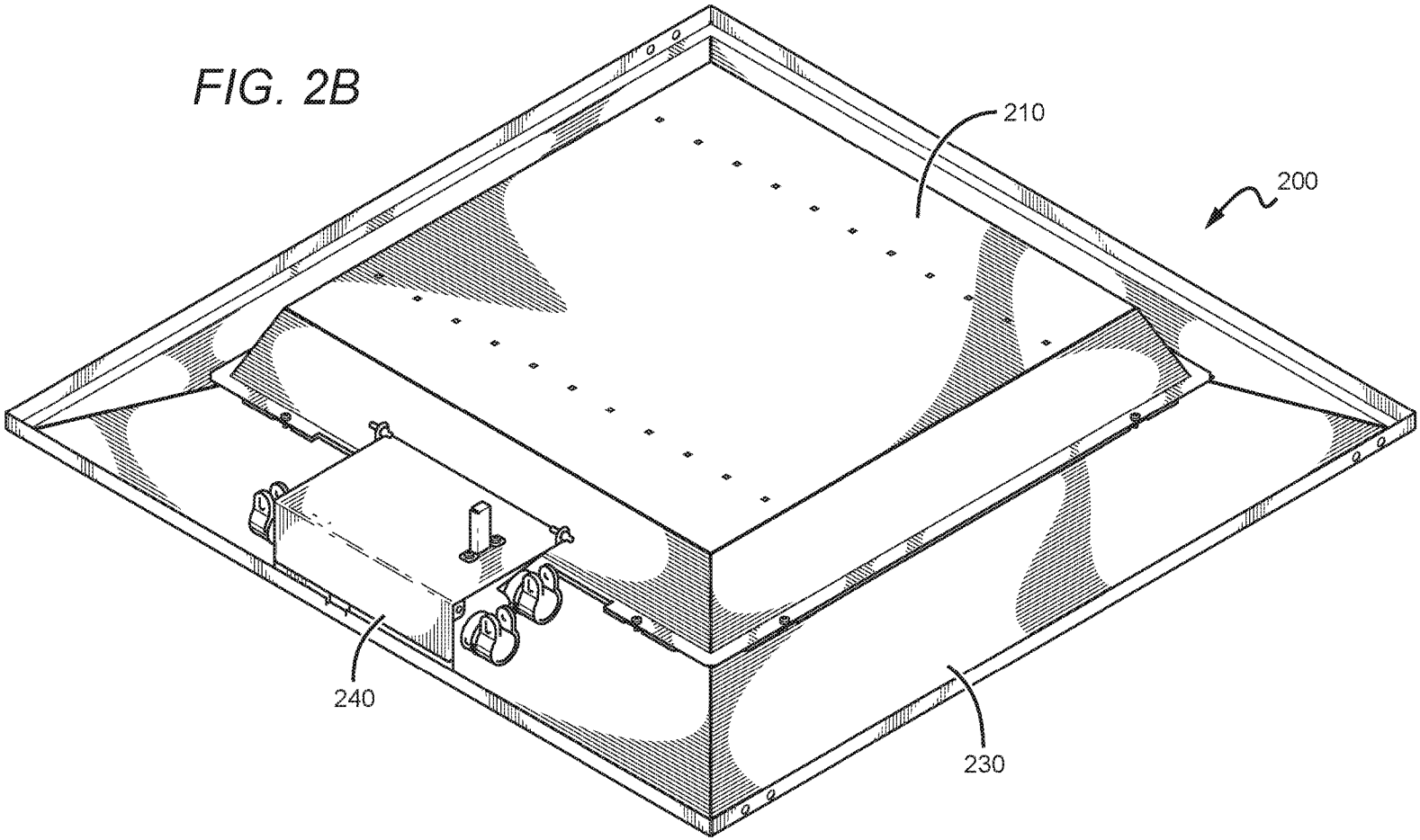
Figure 2C:
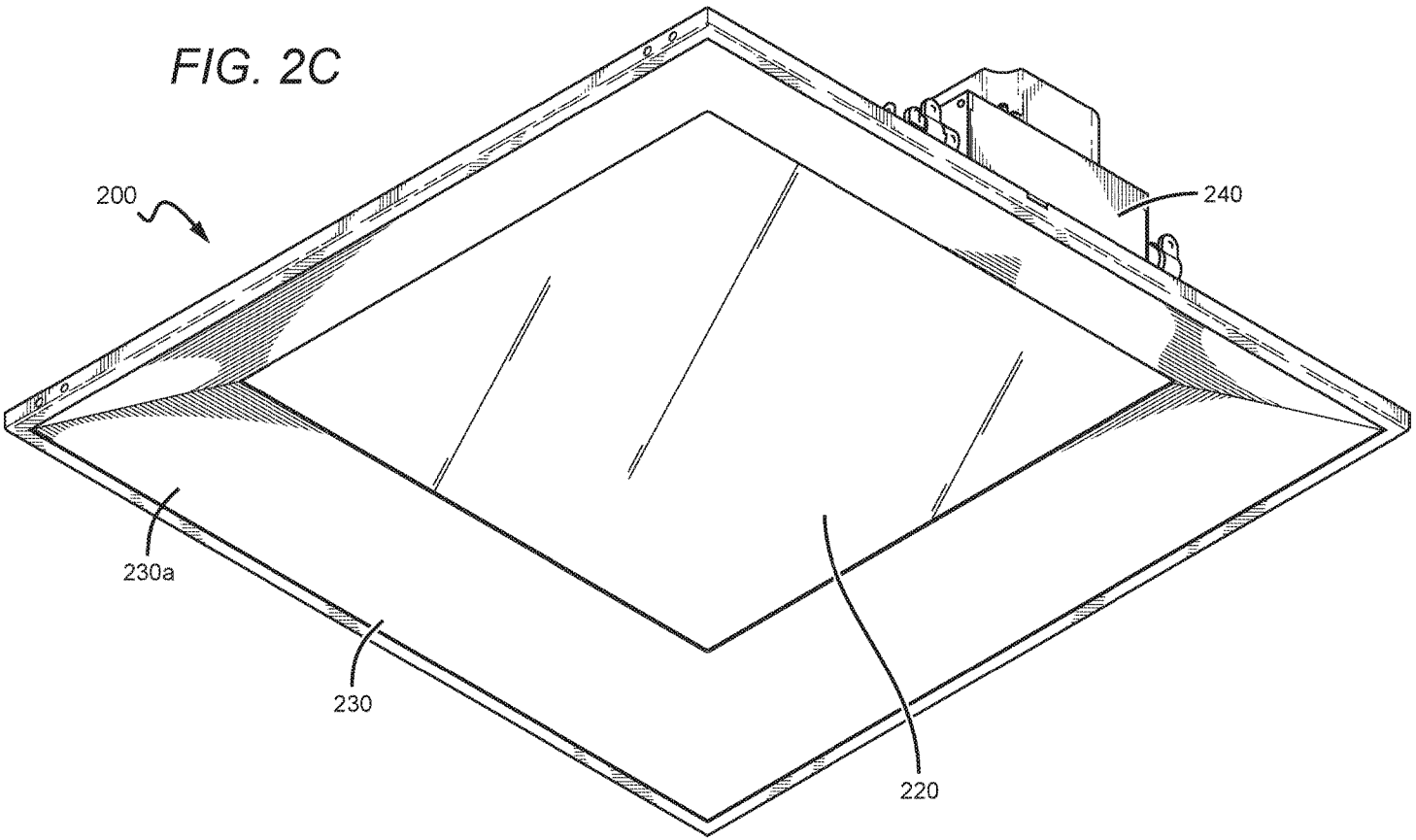
Figure 2D:
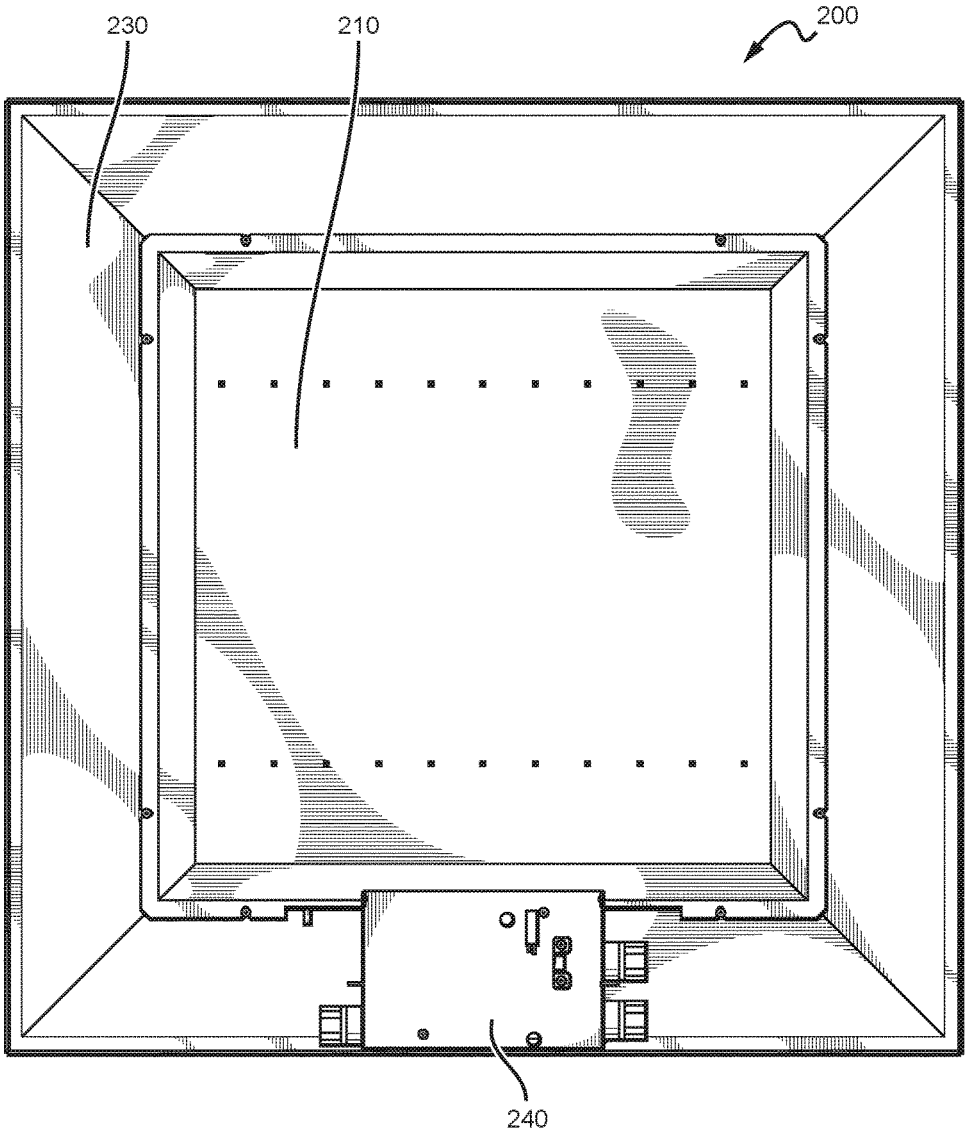
Figure 2E:
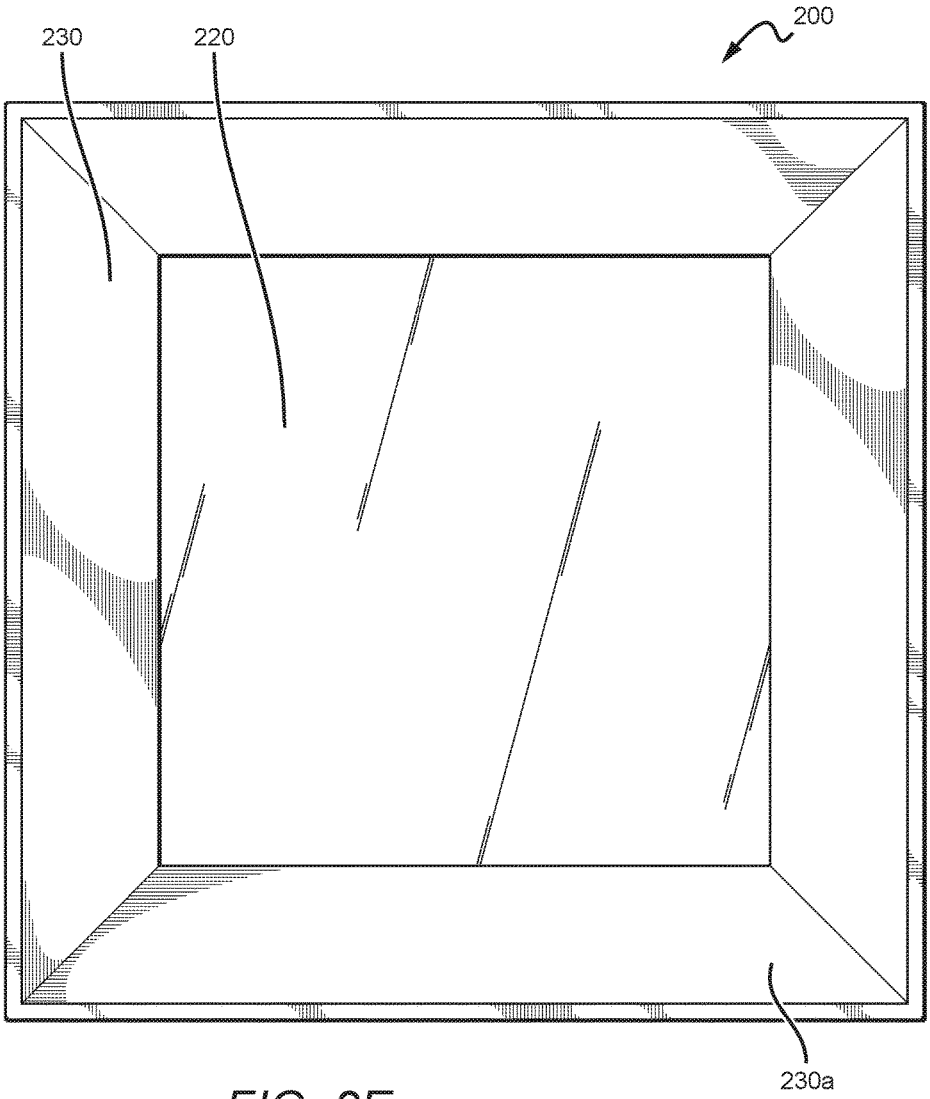
Figure 2F:
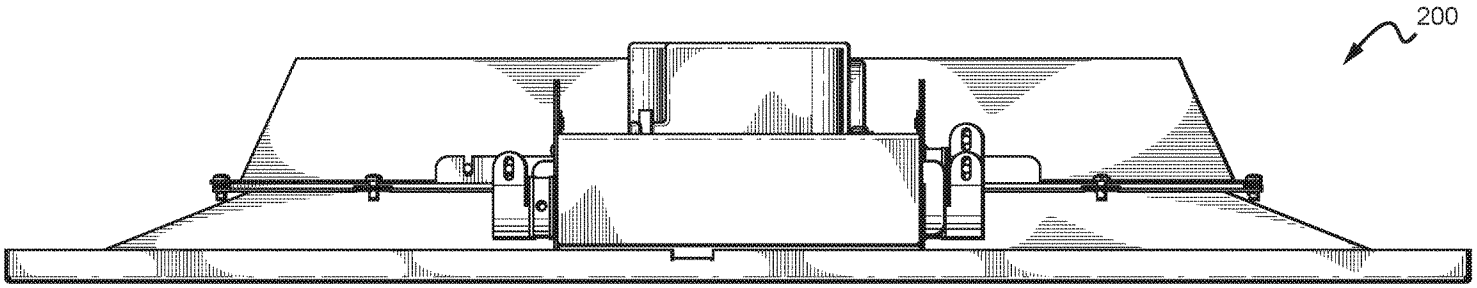
Figure 2G:
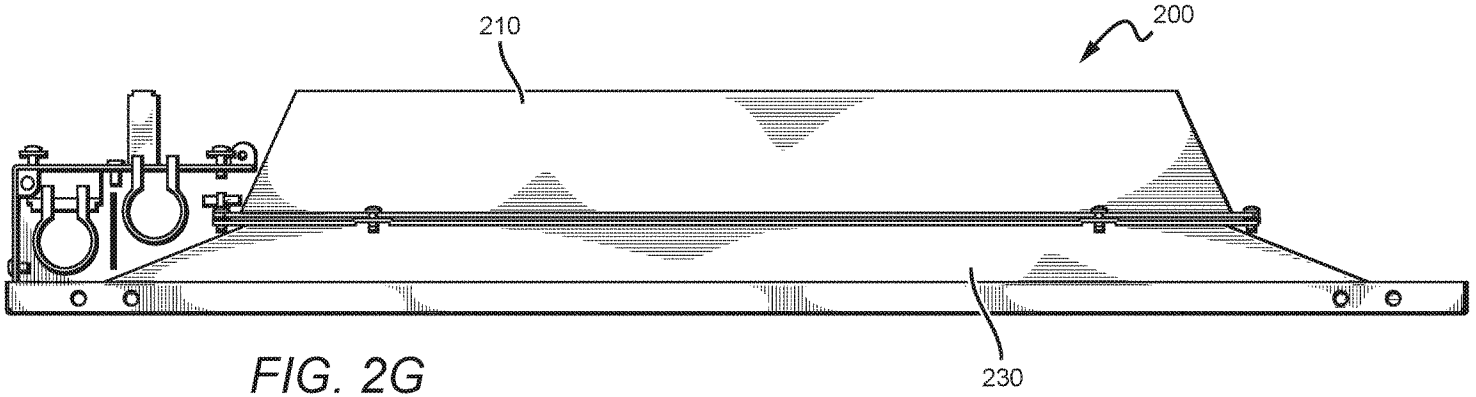

As can be seen best in FIGS. 1F and 1G, both the light engine 110 and the reflector 130 can have trapezoidal cross-sections. In the embodiment shown, the sides of the reflector 130 can rise at a flatter angle than the sides of the light engine 110, or in other terms the light engine 110 can have steeper sides than the reflector 130. In other embodiments, the sides of the light engine 110 and the reflector 130 are at approximately equal angles, while in other embodiments the sides of the light engine 110 can be flatter than those of the reflector 130. A reflector having relatively flat sides, such as the sides of the reflector 130, can help to increase high-angle emission.

One example of a j-box mount location is best seen in FIG. 1D. Many different j-box mount locations are possible. The j-box 140 and other j-boxes in embodiments of the present invention can be mounted in a position such that it does not substantially share a heat dissipation path with the troffer emitters. For example, the a j-box can be mounted partially and/or completely outside a perimeter formed by the emitters, offset from a central vertical axis of an emitter array, horizontally offset from an emitter array, remote to an emitter array, and/or on the periphery of the light engine 110. Such arrangements can result in lower operating temperature for the emitters. These arrangements are discussed in detail in U.S. patent application Ser. No. 14/145,559 to Lui et al. and entitled "Lighting Fixture with Branching Heat Sink and Thermal Path Separation", which is fully incorporated by reference herein in its entirety.

FIGS. 2A-2G are views of a troffer 200 according to another embodiment of the present invention. The troffer 200 can include many of the same or similar elements as the troffer from FIG. 1, including but not limited to a light engine 210, lens 220, reflector 230, and j-box 240. In this embodiment, the light engine 210 can include the light engine shell 212 and the internal reflector 214. Whereas in some embodiments emitters can be mounted directly on the inner surface of the light engine shell 212, in other embodiments emitters can instead be mounted on an internal reflector such as the reflector 214. Any of the embodiments described herein can use the configuration of FIG. 1 wherein emitters are mounted on a light engine shell, or the configuration of FIG. 2 wherein there is an additional reflector at least partially within the shell or wholly within the shell. The use of an internal reflector such as the internal reflector 214 can increase efficacy and/or color mixing, as the internal reflector can be specially shaped or be made of a specific reflective material that may not be amenable to use as a light engine shell.

Embodiments of the present invention, including but not limited to those described above and hereafter, can have many different dimensional measurements. In one embodiment of the present invention, the bottom footprint of the troffer (i.e., the area viewable from the nadir, such as the outer square in FIG. 1E or FIG. 2E) can be about 600 mm×600 mm, about 23.5"×23.5", or about 2 ft×2 ft. One particular embodiment which can be used, for example, in the United States, has a bottom footprint of 603 mm×603 mm. One particular embodiment which can be used, for example, in parts of the world outside the United States can have a bottom footprint of about 595 mm×595 mm. Larger square footprints, such as about 1200 mm×1200 mm, 4 ft×4 ft, or even larger are also possible. Troffers according to the present invention can also have rectangular bottom footprints, such as 600 mm×1200 mm, 600 mm×1800 mm, or larger. Further, the present invention is not limited to square or rectangular footprints, as many different bottom footprint shapes are possible.

Troffers according to the present invention can also require relatively little plenum space due to their relatively thin height profile. For example, embodiments of the present invention which do not utilize a distinct or dedicated heat sink (and thus dissipate the majority of heat through the upper surface of the light engine shell) can have a reduced height. As used herein, the term "distinct heat sink" is used to refer to an element with its primary purpose being heat dissipation. For example, while a light engine shell with emitters mounted thereon can serve as the primary thermal dissipation path in embodiments of the present invention, in one such an embodiment the primary purpose of a shell in such an embodiment would be to support and/or provide a mount surface for emitters, and thus this would not qualify as a "distinct" or "dedicated" heat sink. Some embodiments of the present invention such as, for example, that shown in FIGS. 1A-1G, can have a total height (such as, in some embodiments, from the bottom of the reflector 130 to the top of the j-box 140, or in other embodiments from the bottom of the reflector 130 to the top of the light engine 110) of about 105 mm or less, about 100 mm or less, or about 95 mm to about 105 mm. This can be significantly less than prior art troffers, which can have a height of about 120 mm or more. Many different heights smaller and larger than those discussed above are possible.

Embodiments of the present invention, including but not limited to those described above and those described hereafter, can comprise lightweight materials. For example, a reflector, light engine shell, and/or internal reflector can be fabricated from lightweight sheet metal and/or aluminum, thin galvanized steel, or other materials. Further, some embodiments do not utilize a distinct heat sink, further reducing overall troffer weight. Embodiments utilizing the inner surface of a light engine shell instead of a distinct internal reflector can also have a lower weight. For example, embodiments of the present invention can have a mass of about 4.00 kg or lower, about 3.50 kg or lower such as 3.48 kg, about 3.25 kg or lower, and/or about 3.00 kg or lower, whereas similar prior art troffers can have masses of about 6.00 kg or higher. This difference in weight can be largely due to the lack of a dedicated heat sink in some embodiments, although in some embodiments it is due to other factors such as the materials used.

FIGS. 3A-3E are views of a corner of a troffer according to another embodiment of the present invention. Light engines and/or reflectors according to embodiments of the present invention, such as those shown in FIGS. 3A-3E, can comprise a first portion defining a volume and/or cavity and a second portion that is substantially flat. The first portion can be a central portion and the second portion can be an outer portion, a rim, and/or a rim, although other embodiments are possible; these portions will be discussed in detail below.

The troffer 300 can include many components the same as or similar to those of the troffers 100,200, such as a light engine 310, lens 320, reflector 330 (which can have an inner surface 330*a*), and j-box 340. The light engine 310 can include a light engine rim 312, which can be flat and/or substantially flat and/or can form a bottom perimeter of the light engine 310, while the remainder of the light engine outer shell 310 can form a central portion which can define a cavity. The bottom 312*a* of the rim 312 can form a bottom surface of the light engine 310. Similarly, the reflector 330 can include a rim 332. The reflector rim 332 can have a top 332*a* which can form a top surface of the reflector 330. Lighting engine and/or reflector rims according to the present invention can be flat, substantially flat, and/or form the perimeter of their remainder of their respective element, or can surround another portion of their respective element.

Figure 3C:
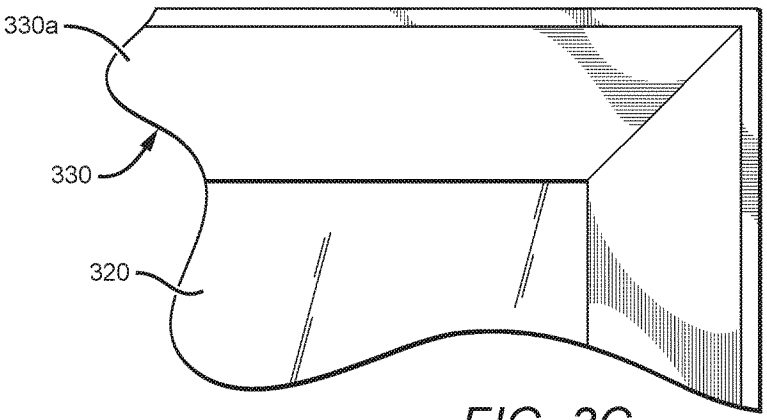
Figure 3D:
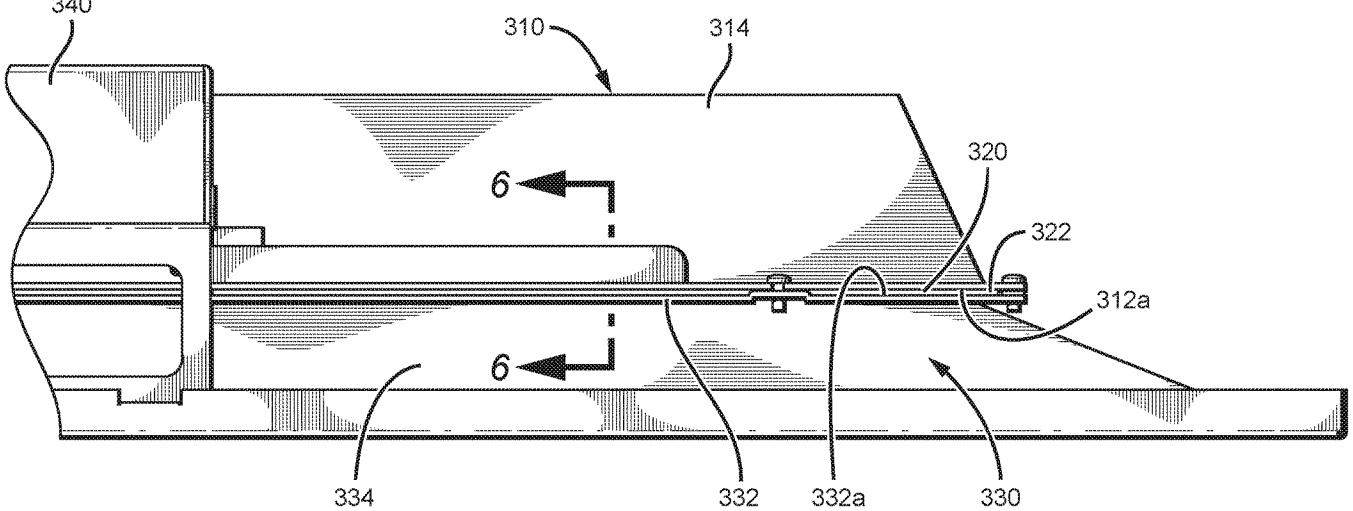
Figure 3E:
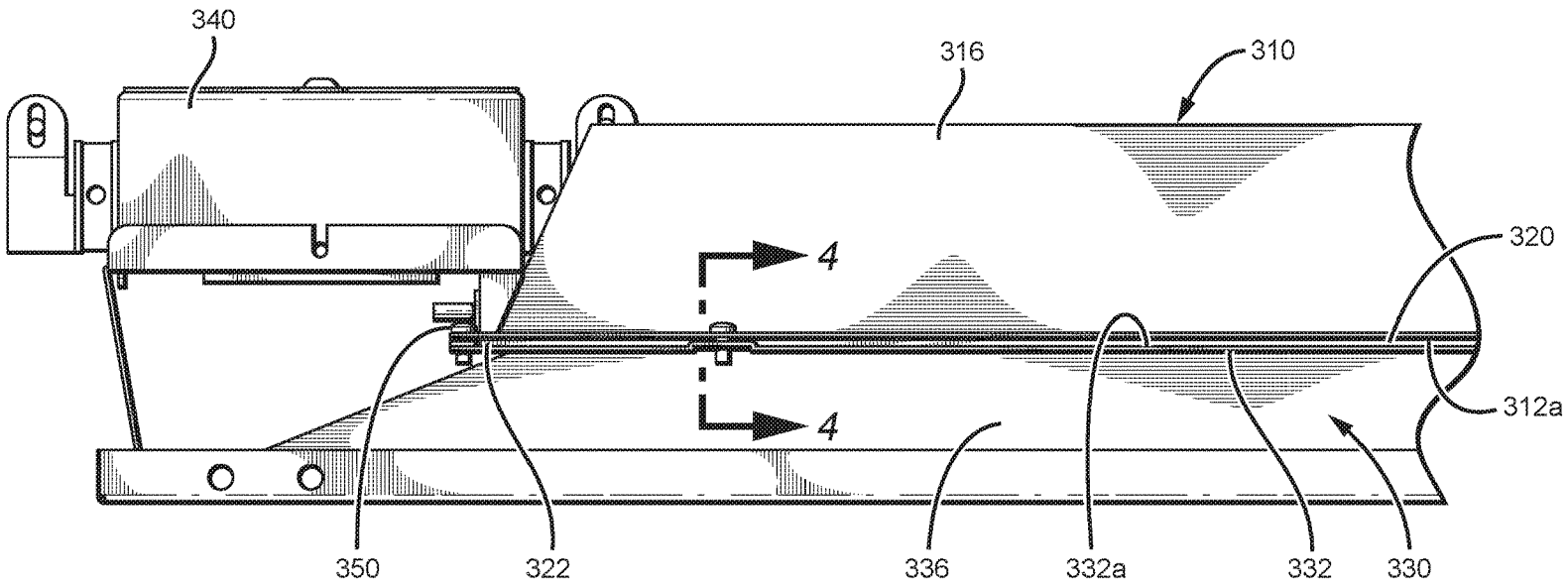

As best seen in FIGS. 3D and 3E, the perimeters of the front/side cross-sections light engines and reflectors according to the present invention, such as the light engine 310 and reflector 330, need not necessarily be aligned, although in some instances they can. In the embodiment shown, the bottom of the front and side surfaces 314,316 of the light engine 310 can be to the outside of the top of the front and side surfaces 334,336 of the reflector 330, such that the bottom of the light engine 310 (excluding the rim 312) has a wider and longer cross-section than the top of the reflector 330 (excluding the rim 332). Alternatively, the top of the reflector 330 can have a wider and longer cross-section than the bottom of the light engine 310, or one of the light engine 310 and reflector 330 can be wider while the other is longer. Because of these potential features, embodiments of the present invention can be used in various applications requiring a fixture with specific height and profile dimensions.

Rims of light engines and/or reflectors according to the present invention can be crimped together to hold a lens in place. The rims 312,332 shown in FIGS. 3A-3E can at least partially align with one another such that at least a portion of the bottom 312*a* of the light engine rim 312 can face and/or overlap with the top 332*a* of the reflector rim 332. In other words, at least part of the rim 312 can be above and/or over at least part of the rim 332. The portions 312,332 can be parallel and/or in parallel planes. The rims 312,332 can overlap enough so as to allow a connector 350 to connect the two portions 312,332. Connectors according to embodiments of the present invention, such as but not limited to the connector 350, can compress a lens between two surfaces, such as surfaces of the rims 312,332. The connector 350 can be any device which forms a mechanical connection between the rims 312,332, including but not limited to a screw, a fastener, an adhesive, soldering, and/or any other connecting means.

Any number of connectors can be used. In one embodiment, each corner portion of the troffer 300 can include two connectors 350, such as a connector 350 on each side of the corner 302 of the troffer 300, shown in FIGS. 3A and 3B.

The lens 320 can be a solid piece without screwholes or other connection means, although in other embodiments connection means are used. The use of a lens without connection means can greatly reduce cost. For example, the lens 320 can be a simple square or rectangle that can be solid, and/or can have no further machining necessary. For example, in the embodiment shown, the lens 320 is a square.

The lens 320 can have a perimeter portion 322 that can extend past the luminous area of the troffer 300, as best seen in FIGS. 3D and 3E. The lens rim 322 can overlap with and/or contact a portion of the light engine rim 312, the reflector rim 332, or both. In one embodiment, at least part of the lens perimeter portion 322 is flush with the light engine rim 312, the reflector rim 332, or both. In one embodiment a portion of the lens 320, such as the lens perimeter portion 322 for example, is directly on part of the light engine 310, such as the light engine rim 312, directly on part of the reflector 330, such as the reflector portion 332, or directly on both. In another embodiment, an adhesive can be between the lens perimeter portion 322 and one or both of the rims 312,332. A connector, such as the connector 350, can be applied such that the rims 312,332 and the perimeter portion 322 are pressed tightly against one another and/or compressed. For instance, a screw can apply pressure such that the rims 312,332 and perimeter portion 322 are pressed tightly against one another. In another embodiment, an adhesive can hold the rims 312,332 and perimeter portion 322 tightly against one another. The connection described above can be one means by which the lens 320 can be held in place, and in one embodiment it is the only means, although in some embodiments other means are also used.

Figure 4A:
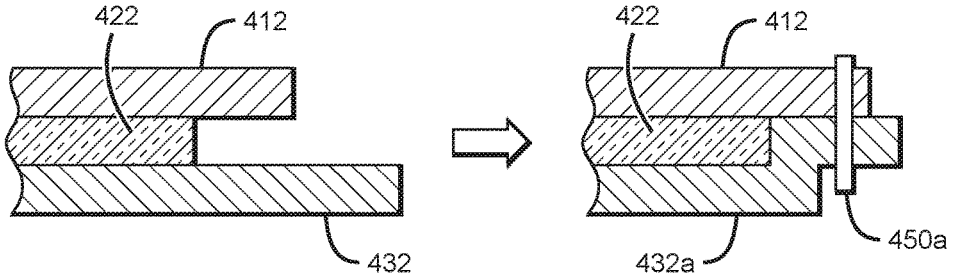
FIGS. 4A-4C are magnified cross-sectional views of embodiments according to the present invention of part of the troffer from FIGS. 3A-3E along the line 4-4.

One securing means for securing the lens 320 in place can be a crimping of one of the rims 312,332. Three examples of crimping designs according to the present invention can be seen in FIGS. 4A-4C. These views show part of a troffer similar to or the same as the troffer 300, taken along the line 4-4 from FIGS. 3B and 3E. In the embodiment of FIG. 4A, the reflector rim 432*a* can be tightly crimped such that it contacts, is against, is flush with, partially covers, and/or completely covers the outer edge of the lens perimeter portion 422 and/or the bottom edge of the rim 412 overhanging the lens 422 in the crimped area (i.e., in some embodiments only a portion of the perimeter is crimped as shown in FIGS. 3A, 3D, and 3E, so a portion of the reflector rim 432*a* extending into the page may not be crimped and thus may not contact the bottom of the light engine rim). It is understood that a small space can remain at the intersection of the rims 412,432*a* and perimeter portions 422, such as due to manufacturing practicalities or tolerances. The configuration shown in FIG. 4A can provide the most secure connection and be the most effective at preventing movement of the lens 422 amongst the three configurations shown in FIGS. 4A-4C.

A connector, such as the connector 450*a*, can optionally be used to further secure the connection between the rims 412,432*a* and to further secure the lens perimeter portion 422 in position. Connectors according to the present invention can clamp the lens between the elements above and below the lens, such as by compressing the lens. The lens can be clamped between the rims of a light engine and a reflector, such as the rims 412,432*a*, and/or other rims described herein. In one embodiment, a crimp such as that shown in FIGS. 4A-4C can be formed when the connector is attached to the rims. For example, the pressure of applying the connector can cause one rim to be crimped.

Embodiments of the present invention can prevent lens movement through clamping and/or compressing the lens. Lens movement can also be prevented by specifically preventing lateral movement. For example, at least one barrier to movement (such as a crimped portion or a connector) can be on each side of the lens such that it cannot move laterally. For example, a crimped portion can be on and/or adjacent each edge of a lens, and/or a connector can be on and/or adjacent each edge of a lens. Combinations of crimped portions and lenses are possible.

Figure 4B:
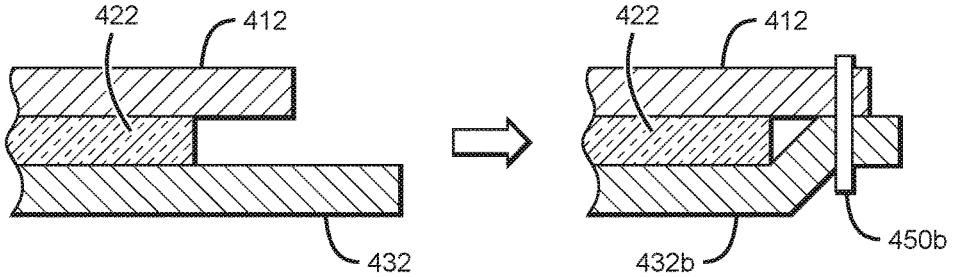

In the embodiment shown in FIG. 4B, the reflector rim 432*b* can be crimped so as not to contact the outer edge of the lens. The rim 432*b* can still be crimped so as to contact part of the bottom of the light engine rim 412, and can be flush with part of the overhanging portion of the light engine rim 412. The configuration shown in FIG. 4B may be more practical for manufacturing purposes than the configuration shown in FIG. 4A. A connector, such as the connector 450*b*, can optionally be used to further secure the connection between the rims 412,432*b* and to further secure the lens perimeter portion 422 in position.

Figure 4C:
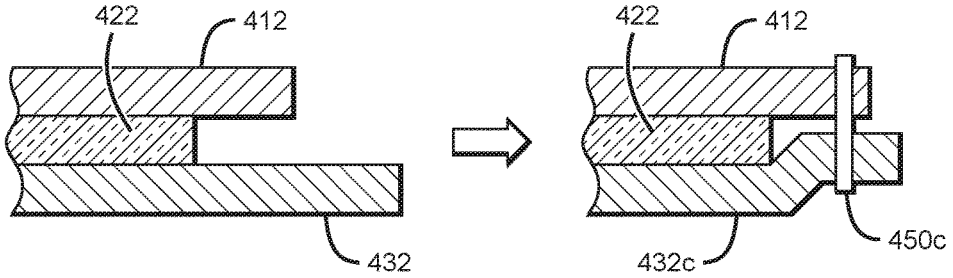

In the embodiment shown in FIG. 4C, the reflector rim 432*c* can be less crimped, and does not touch the outer edge of the lens 422 or the bottom of the light engine rim 412. A connector, such as the connector 450*c*, can optionally be used to further secure the connection between the rims 412,432*c* and to further secure the lens perimeter portion 422 in position.

Figure 5A:
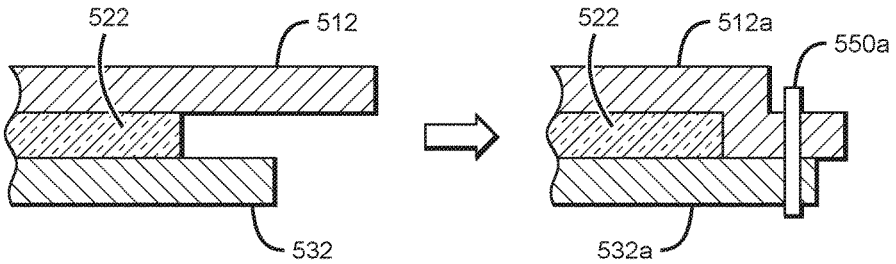
FIGS. 5A-5C are magnified cross-sectional views of embodiments according to the present invention of part of the troffer from FIGS. 3A-3E along the line 4-4.
Figure 5B:
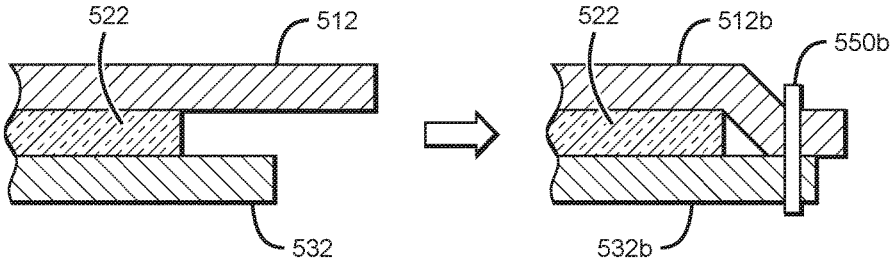
Figure 5C:
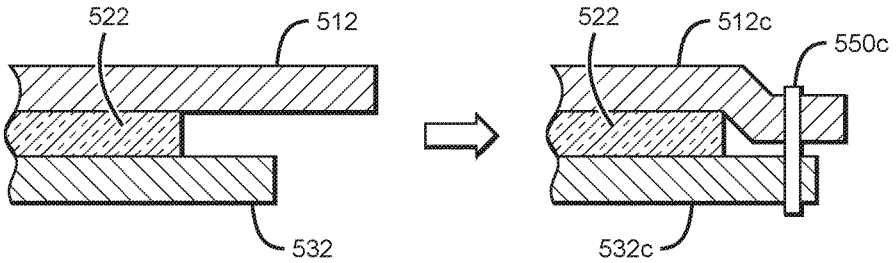

While FIGS. 4A-4C describe manners in which parts or all of reflector rims are crimped, it is understood that parts or all of light engine rims can be crimped in the same or a similar manner, as shown in FIG. 5A-5C with the light engine rims 512*a*,512,512*c*, respectively. In one embodiment of the present invention, the material that is lighter, less sturdy, and/or less rigid is crimped between the light engine rim and the reflector rim is crimped while the other is not.

Similarly, in some embodiments both the light engine rim and the reflector rim can be crimped in the manner of FIGS. 4A and 5A, in which they can combine to cover the outside edge of a lens, in the manner of FIGS. 4B and 5C, in which they would not cover the outside edge of the lens but would meet and/or be flush with one another, and/or can be crimped in the manner of FIGS. 4C and 5C, in which the portions may not meet.

Although connectors are shown, for example, in FIGS. 4A-4C, 5A, and 50 as passing all the way through both rims, this is not always necessary. For example, the connection 550*b* in FIG. 5B passes entirely through the light engine rim 512*b* but not entirely through the reflector rim 532. Such an arrangement can help to hide connectors from view in embodiments of the present invention. In other embodiments, the connectors are hidden from view by the reflector.

Figure 6A:
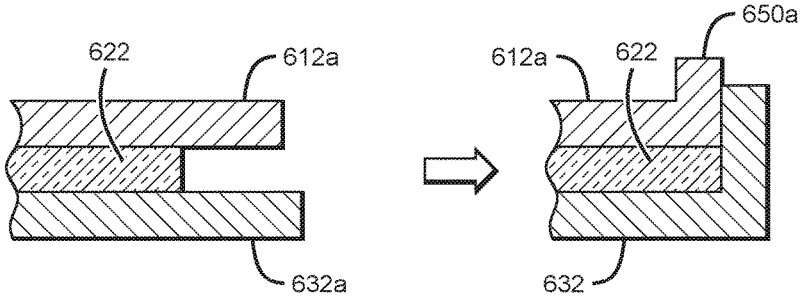
FIGS. 6A-6C are magnified cross-sectional views of embodiments according to the present invention of part of the troffer from FIGS. 3A-3E along the line 6-6.
Figure 6B:
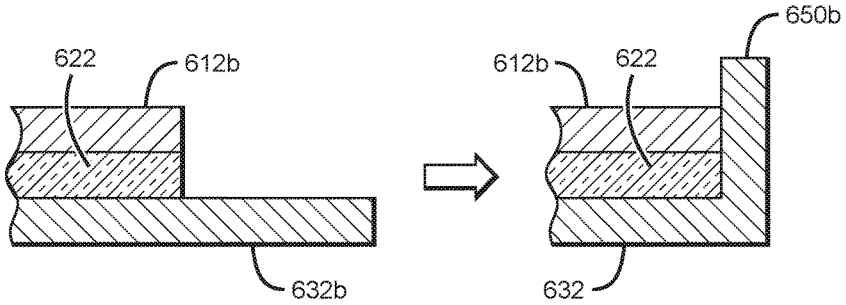
Figure 6C:
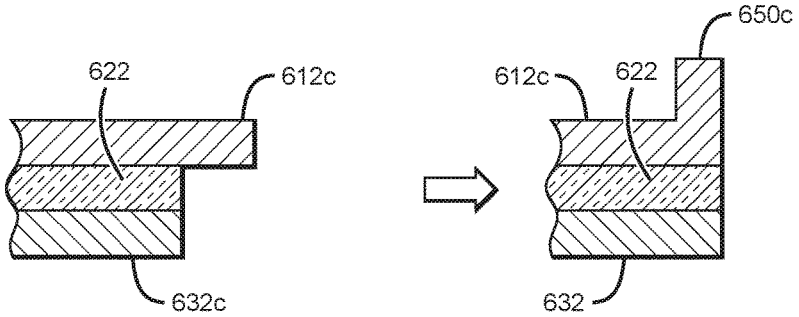

FIGS. 6A-6C show another manner in which portions of the rims 312,332 from FIGS. 3A-3E may be crimped. This view shows part of a troffer similar to or the same as the troffer 300, taken along the line 6-6 from FIGS. 3B and 3D. In some such embodiments, the lower rim (such as the portion 632*b* or the portion 632*c*) can be crimped so as to cover the edge of one or both of the rims/perimeter portions above (such as the portions 622,612*a* or the portions 622, 612*b*). In these embodiments, the upper areas 650*a*,650*b*, 650*c* can serve as a support for a j-box, as will be discussed in detail below. It is understood that while the embodiments of FIGS. 6A-6C show the lower rim being crimped upward, alternatively the upper rim can be crimped downward. Further, it is also understood that the portion 650*b* could be folded over the upper rim 612*b*.

Many methods of crimping a rim or other areas are possible. For example, a portion can be crimped using pressing or stamping. Many other methods are possible.

It should be noted that crimped portions of light engines described above with regard to FIGS. 4-6 are discussed with reference to a light engine shell without a distinct internal reflector, such as the internal reflector 214 from FIGS. 2A-2G. However, the above embodiments can be modified by one of skill in the art to account for a distinct internal reflector in embodiments where such a reflector is present. In the embodiments described herein comprising both a shell and internal reflector, one or both can have a rim. For example, in the embodiments of FIGS. 5A-5C, an internal reflector could be crimped together with the light engine shell in a manner similar to elements 512*a*,512*b*,512, or alternatively only the internal reflector rim could be crimped while the light engine shell rim remains uncrimped. Similarly, in FIGS. 6A and 6C a light engine shell and internal reflector rims could be crimped upward together, or, alternatively, the light engine shell rim could be crimped upward while the internal reflector rim remains uncrimped. In some embodiments involving downward crimping of a rim of the light engine (e.g. FIGS. 5A-5C), the light engine shell and the internal reflector rims can be crimped downward, or the internal reflector rim alone could be crimped downward. In some embodiments involving upward crimping of a rim of the light engine (e.g. FIGS. 6A and 6C), the light engine shell and the internal reflector rims can be crimped upward, or the light engine shell rim alone could be crimped upward. Alternatively, in one embodiment, an internal reflector rim is crimped downward (e.g., in a manner similar to one of elements 512*a*,512*b*,512*c* from FIGS. 5A-5C), while a light engine shell rim is crimped upward (e.g., in a manner similar to one of FIGS. 612*a*,612*c* from FIGS. 6A and 6C).

Although in the embodiments described above no connector passes through the lens, in other embodiments of the present invention connection means can be used. For example, lenses according to the present invention can include screwholes, and a connector such as the connector 350 could pass through the rim 312, lens, and rim 332 in succession.

Figure 7A:
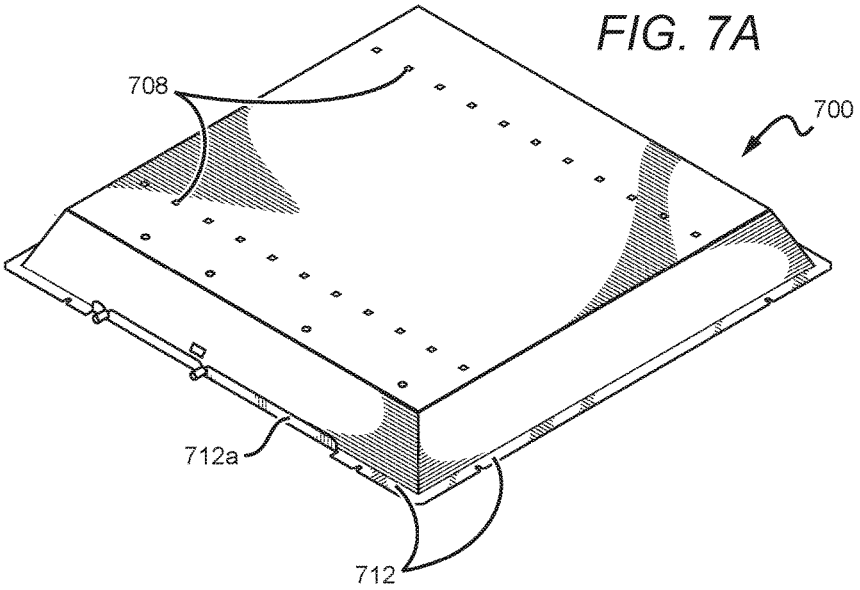
Figure 7B:
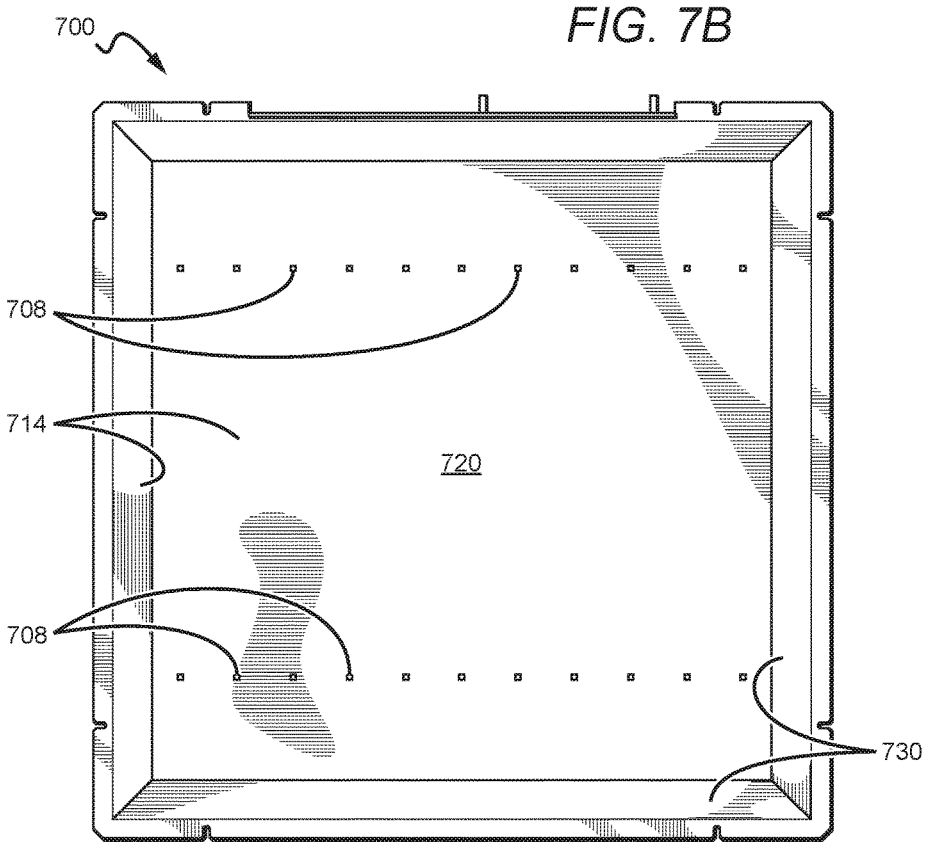

FIGS. 7A-7E show views of a light engine shell 700 according to one embodiment of the present invention. The light engine shell 700 can contain many elements similar to or the same as the light engines shown in FIGS. 1-6 above. As best seen in FIGS. 7A and 7B, a rim 712 of the light engine 700 can include a crimped portion 712*a*. The crimped portion 712*a* can partially support a j-box (not shown), as will be discussed in detail below. The crimped portion 712*a* can be crimped in one of the manners shown in FIGS. 6A-6C, although other designs are possible.

The light engine shell 700 also includes an inner surface 714. The inner surface 714 can include a mount portion 720 and a reflector portion 730. The inner surface 714, including one or both of the mount portion 720 and the reflector portion 730, can comprise similar or the same materials as an inner surface of a reflector, which will be discussed in detail below. The mount surface in embodiments of the present invention, such as the mount portion 720, can be at the back or top of the troffer and face the nadir direction, meaning that the troffer is a direct lighting fixture as opposed to an indirect lighting fixture. Using a reflective surface can help to partially or completely eliminate the contrast that a viewer would otherwise see between PCB strips (to be discussed below) and the mount surface.

The mount surface 714 can include attachment portions 708 which can be used for securing a light emitter holder or submount. The attachment portions 708 can be integral to the mount surface 714, and/or can be formed by stamping, for example. The attachment portions 708 can be, for example, holders, hooks, or flanges, although other embodiments are possible. Attachment portions of a light engine will be discussed in detail below.

In some embodiments of the present invention such as that described above and below, the inner surface of the light engine shell can be designed to act as a reflector, as discussed above. However, in alternative embodiments, a reflector similar to the reflector 214 from FIG. 2A can be included as a separate piece that can be attached to the light engine shell. These light engine reflector designs can be substituted for one another in any of the embodiments described herein.

Light engines according to the present invention can comprise any number, arrangement, color, type, and/or combination of emitters, such as but not limited to light emitting diodes. Many different types of emitters can be used in embodiments of the present invention. In some embodiments the emitters are solid state emitters such as LEDs or LED packages. Many different LEDs can be used, such as those commercially available from Cree Inc., under its DA, EZ, GaN, MB, RT, TR, UT, XT, XH, and XQ families of LED chips. Further, many different types of LED packages can be used in embodiments of the present invention. Some types of chips and packages are generally described in U.S. patent application Ser. No. 12/463,709 to Donofrio et al., entitled "Semiconductor Light Emitting Diodes Having Reflective Structures and Methods of Fabricating Same", U.S. patent application Ser. No. 13/649,052 to Lowes et al., entitled "LED Package with Encapsulant Having Planar Surfaces", and U.S. patent application Ser. No. 13/649,067 to Lowes et al., entitled "LED Package with Multiple Element Light Source and Encapsulant Having Planar Surfaces", and U.S. patent application Ser. No. 13/770,389 to Lowes et al. and entitled "LED Package with Multiple Element Light Source and Encapsulant Having Planar Surfaces", each of which is commonly assigned with the present application and each of which is fully incorporated by reference herein in its entirety.

The emitters can emit many different colors of light. One embodiment can utilize at least some emitters emitting white light (or chips emitting blue light, part of which is converted to yellow and/or green light to form a white light combination). The use of white emitters can be particularly applicable to direct lighting troffers, where color mixing can be a more prevalent issue than in indirect lighting troffers. With white emitters, less color mixing has to be performed by other elements of the troffer (such as a reflector) in comparison to embodiments having multiple color emitters (such as RGB or RGBA emitters), although these embodiments are also possible.

In one embodiment, at least some of the emitters can be LED chips and/or packages which can, in some embodiments, have an emission pattern that is broader than Lambertian, such as, for example, those described in U.S. patent application Ser. Nos. 13/649,052, 13/649,067, and 13/770,389. Emitters that are particularly applicable to embodiments of the present invention can include Cree XQ-B, XQ-D, and/or XH-G packages, the data sheets of which are fully incorporated by reference herein in their entirety. Many other emitter types are possible.

In another embodiment, the emitters can be phosphor-coated LEDs such as, for example, those described in U.S. patent application Ser. Nos. 11/656,759 and 11/899,790, both to Chitnis et al. and both entitled "Wafer Level Phosphor Coating Method and Devices Fabricated Utilizing Method," both of which are commonly assigned with the present application and both of which are fully incorporated by reference herein. In one embodiment the emitters are phosphor-coated LED chips and/or packages with emission patterns that are broader than Lambertian. In another embodiment, these LEDs emit in the blue spectrum and are covered in a yellow phosphor, resulting in a white emission. In another embodiment the emitters can have a Lambertian emission profile. Combinations of these attributes are possible.

Figure 8B:
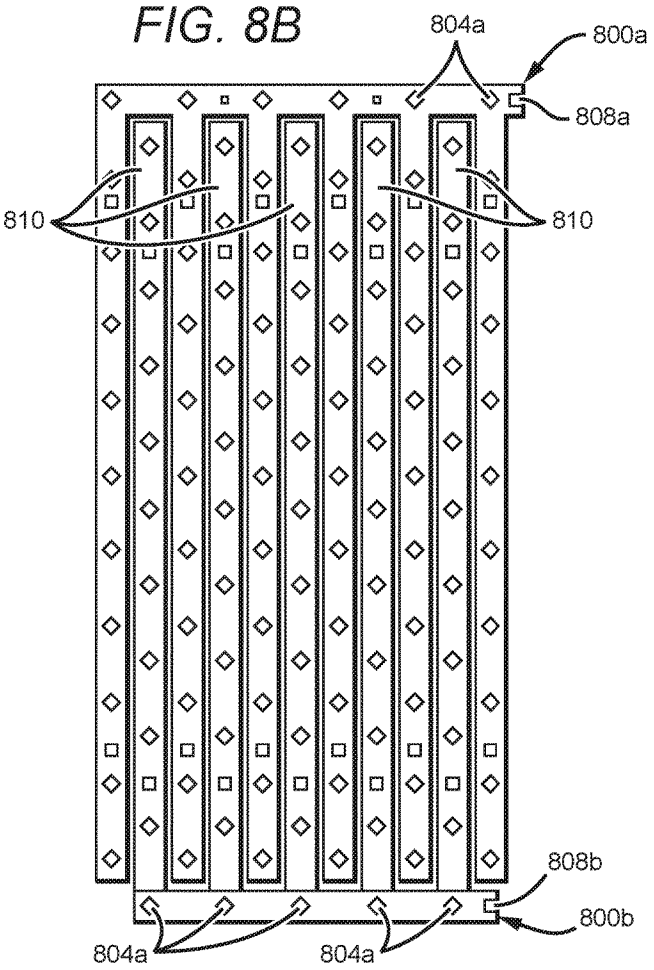
FIGS. 8A and 8B are views of a wafer before and after separation into panels, respectively, according to one embodiment of the present invention.
Figure 8A:
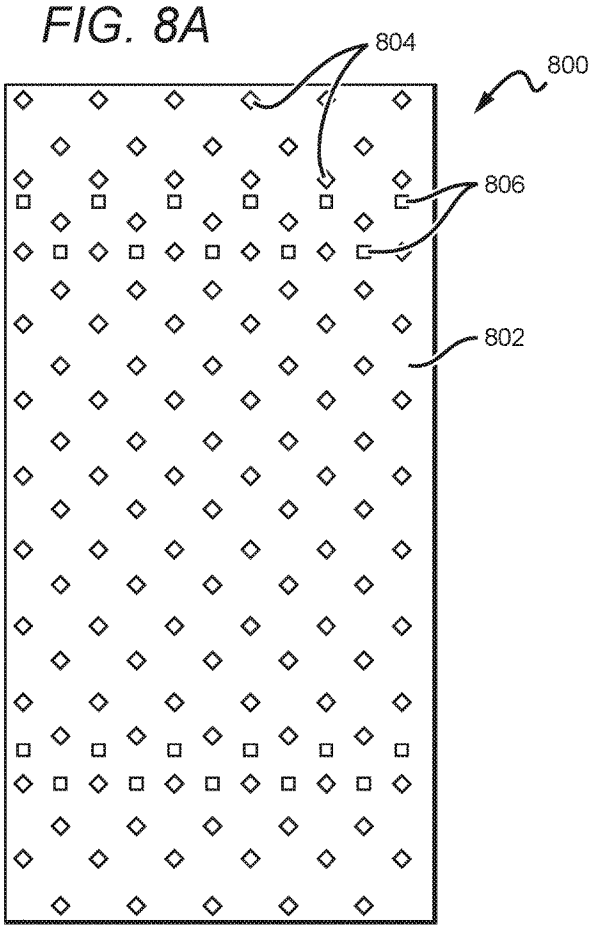

FIG. 8A shows a wafer 800 with a plurality of emitters 804 on a common submount 802, such as a printed circuit board ("PCB"). While element 802 will be referred to herein as a PCB, it is understood that this term is used generically and any common submount can be used, including but not limited to a submount providing electrical connections between emitters. The wafer can include attachment points 806 which can take various forms and can be used for mounting to a mount surface; in the embodiment shown the connection points 806 are holes, but other embodiments are possible.

In embodiments of the present invention, emitters can be driven at a drive current much lower than their maximum drive current in order to reduce the amount of heat that is generated. This is one factor that can allow for the lack of a dedicated heat sink, although other embodiments lacking this factor can also lack a dedicated heat sink. For example, emitters can be driven at 100 mA or under, and/or at under 25% of their maximum drive current. In one such embodiment, the emitters are driven at about 80 mA and/or about 81.8 mA while having a maximum drive current of about 350 mA. In one even more specific embodiment, the emitters are arranged in an 11×11 array of 121 total emitters having a maximum drive current of about 350 mA and being driven at about 80 mA and/or about 81.8 mA.

Prior art methods of cutting and/or forming emitter arrays on a PCB can result in substantial wasted materials, including PCB material. The wafer 800, on the other hand, can be cut so as to minimize material waste, as shown in FIG. 8B. In this embodiment, the wafer 800 is separated and/or cut so as to form two "E-shapes". In this case, the emitters 804 are to be used in an 11×11 array, as will be discussed in detail below. Thus, the wafer 800 can be cut into two E-shaped emitter panels, which can include one panel 800*a* with one end portion 808*a* and six strips 810, and a second panel 800*b* with one end portion 808*b* and five strips 810. Emitters such as the emitters 804*a* can be included on portions of an end portion, such as the end portion 808*b*, adjacent to where a strip 810 meets the end portion.

It is understood that in other embodiments of the present invention, wafers can be cut in any number of ways to form panels having varying number of strips. In another embodiment, a wafer can be cut into two E-shaped panels with an equal number of strips or an unequal number of strips (such as, for example, one panel with one more strip than another panel), and the number of strips in each panel can be four or fewer strips, five strips, six strips, or 7 or more strips.

Figure 9A:
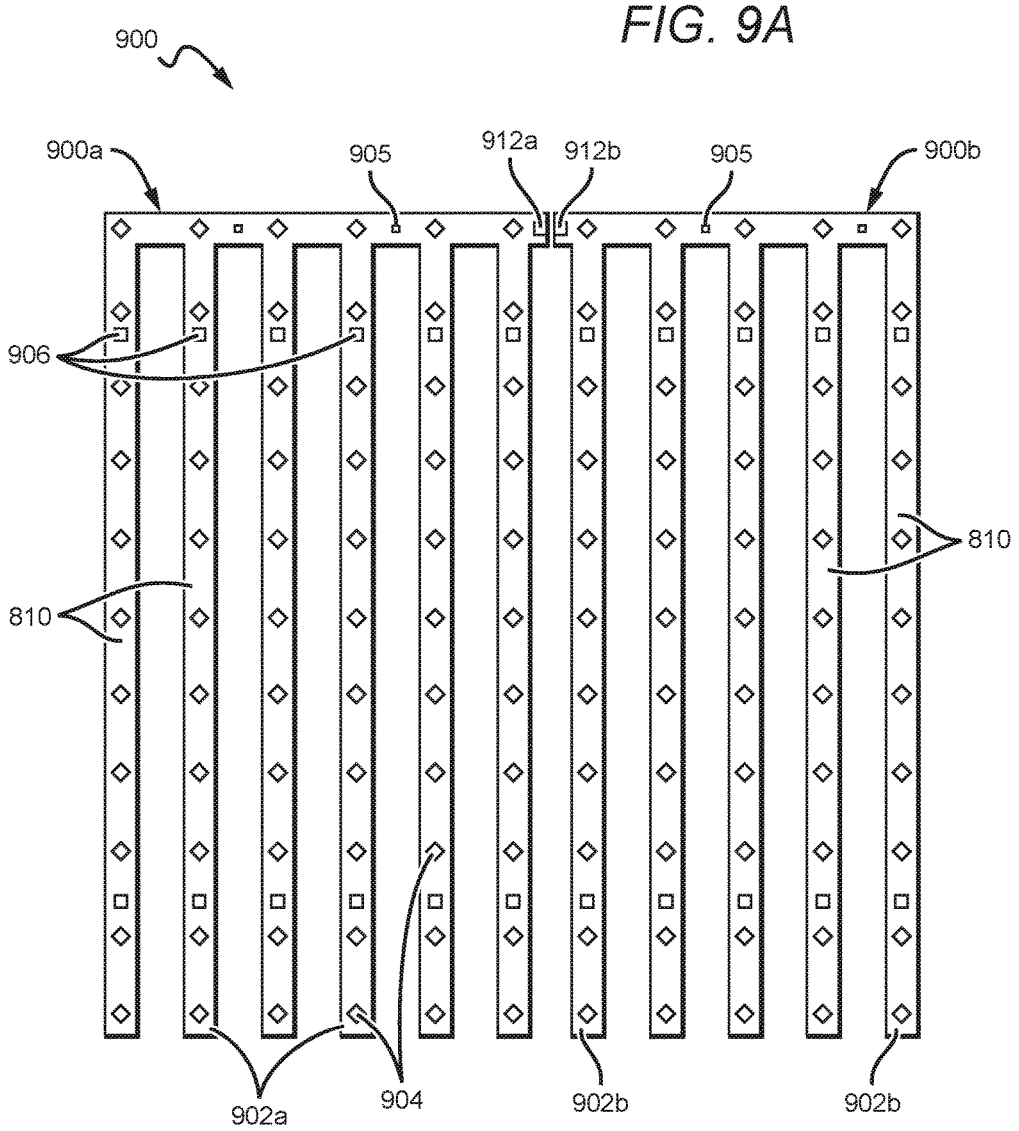
FIGS. 9A and 9B are views of exemplary emitter arrays according to embodiments of the present invention.

FIG. 9A shows one embodiment of an emitter array 900 according to the present invention. The emitter array 900 can include two panels 900*a* and 900*b*, which can be similar to or the same as the panels 800*a*,800*b* from FIG. 8B and/or can include common submounts 902*a*,902*b* and emitters 904. The panels 900*a*,900*b* can be formed from a single submount/wafer, such as by the method shown in FIGS. 8A and 8B. While the emitters 904 are shown as linearly aligned, this is not required and other embodiments are possible.

The emitters 904 can be mounted on the PCB 902*a*,902*b* in such a way as to increase luminous uniformity. For example, in the embodiment shown, the emitters 904 can have a substantially square footprint. These emitters 904 can be mounted such that the emitter edges are at about 45° angles with the edges of the strips 910, which can increase luminous uniformity over emitters mounted with edges parallel to the strips. While the embodiment shown shows square emitters 904 and rectangular strips 910, many different embodiments are possible, including but not limited to embodiments where emitters are misaligned with respect to their surrounding PCB.

The spacing between emitters can depend on a number of factors, including but not limited to the size of the fixture in which the array will be placed, the desired luminous intensity, and the desired output profile, to name a few. In this embodiment, the emitters 904 can be about 30-35 mm center-to-center from one another, and/or be about 33 mm center-to-center from one another, although smaller and larger distances are possible. In an 11×11 array, this can result in an array perimeter having a length and width of about or just over 330 mm.

The panels 900*a*,900*b* can each comprise a connection point 912*a*,912*b* where the panels can be electrically connected, such as through a wire bond, for example. The connection points 912*a*,912*b* can be adjacent one another, or alternatively can be remote to one another. The panels

900*a*,900*b* can in combination form a square or rectangular array, although many other shapes are possible. The panels 900*a*,900*b* can also include end attachment points 905 and strip attachments points 906 which can be, for example, holes, although many other attachment point types are possible. The attachment of the panels 900*a*,900*b* to one or more other elements will be described in detail below.

Figure 9B:
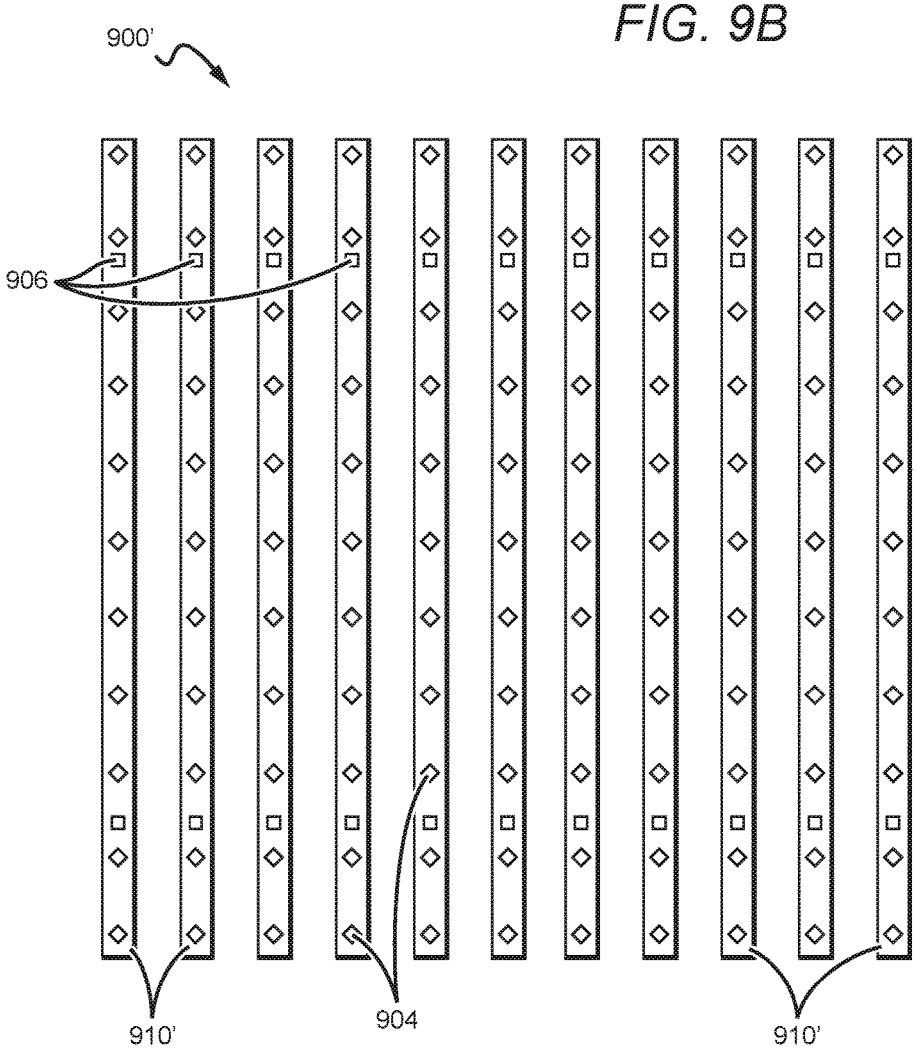

While the FIG. 9A embodiment can include strips 910 that are interconnected such as in E-shapes, the strips need not necessarily be interconnected. For example, FIG. 9B shows one embodiment of an emitter array 900' according to the present invention, which can include strips 910' which are not interconnected. Further, other embodiments do not necessarily include strips; for example, discrete emitters can be used.

Further, in embodiments of the present invention the spacing shown in FIGS. 9A and/or 9B can be varied. For example, the spacing between each strip can be varied to achieve better luminous uniformity. In one embodiment, the strips are closer together toward the outside of the array and further apart toward the inside of the array. This helps to remedy the fact that the edges of a troffer can be less luminous than the center. The spacing of the emitters on strips can also be varied. For example, in one embodiment, emitters are closer together toward the end of a strip and further apart toward the middle of a strip.

Figure 10A:
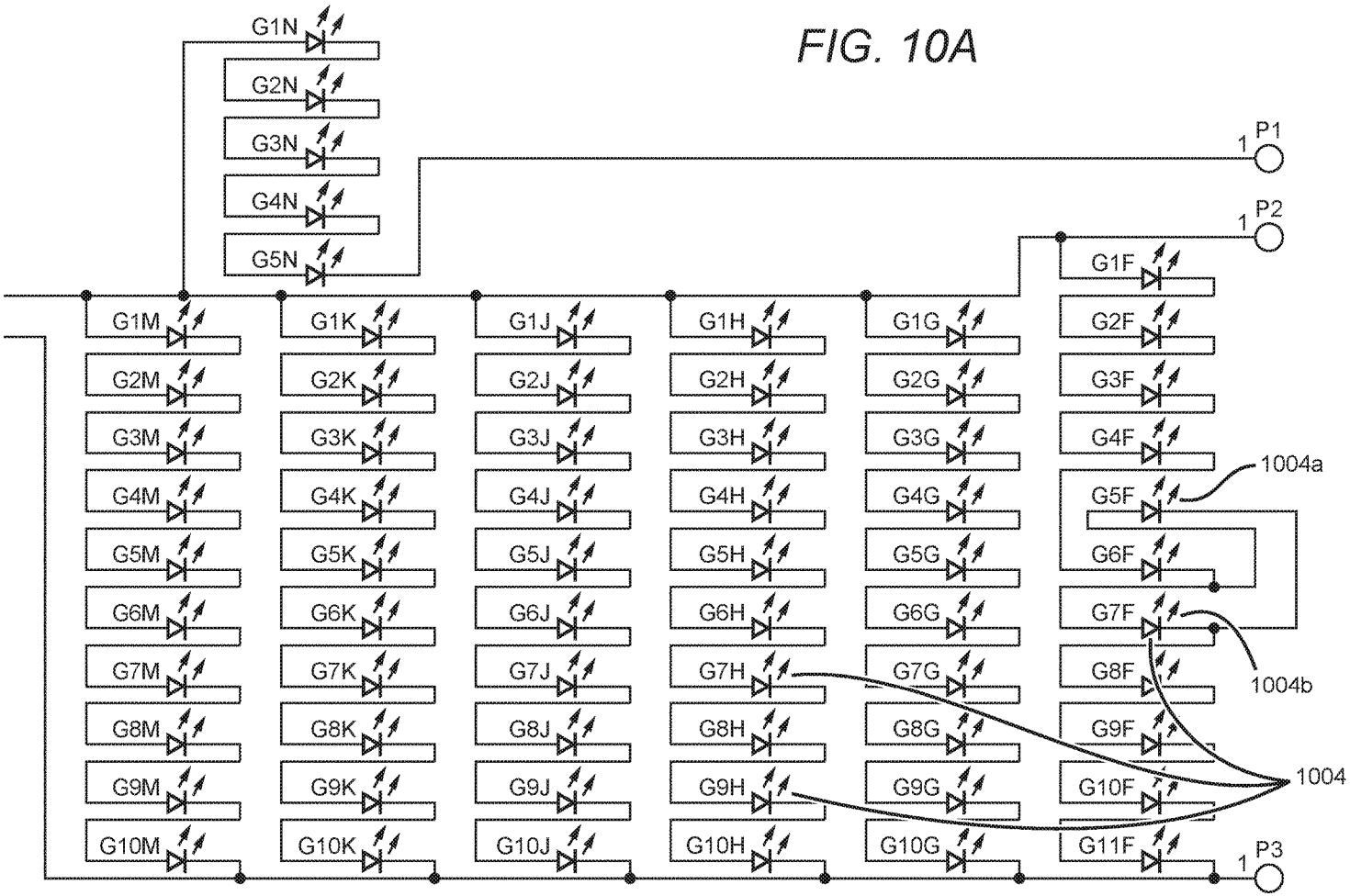
FIGS. 10A and 10B are exemplary circuit diagrams of emitter panels according to two embodiments of the present invention.
Figure 10B:
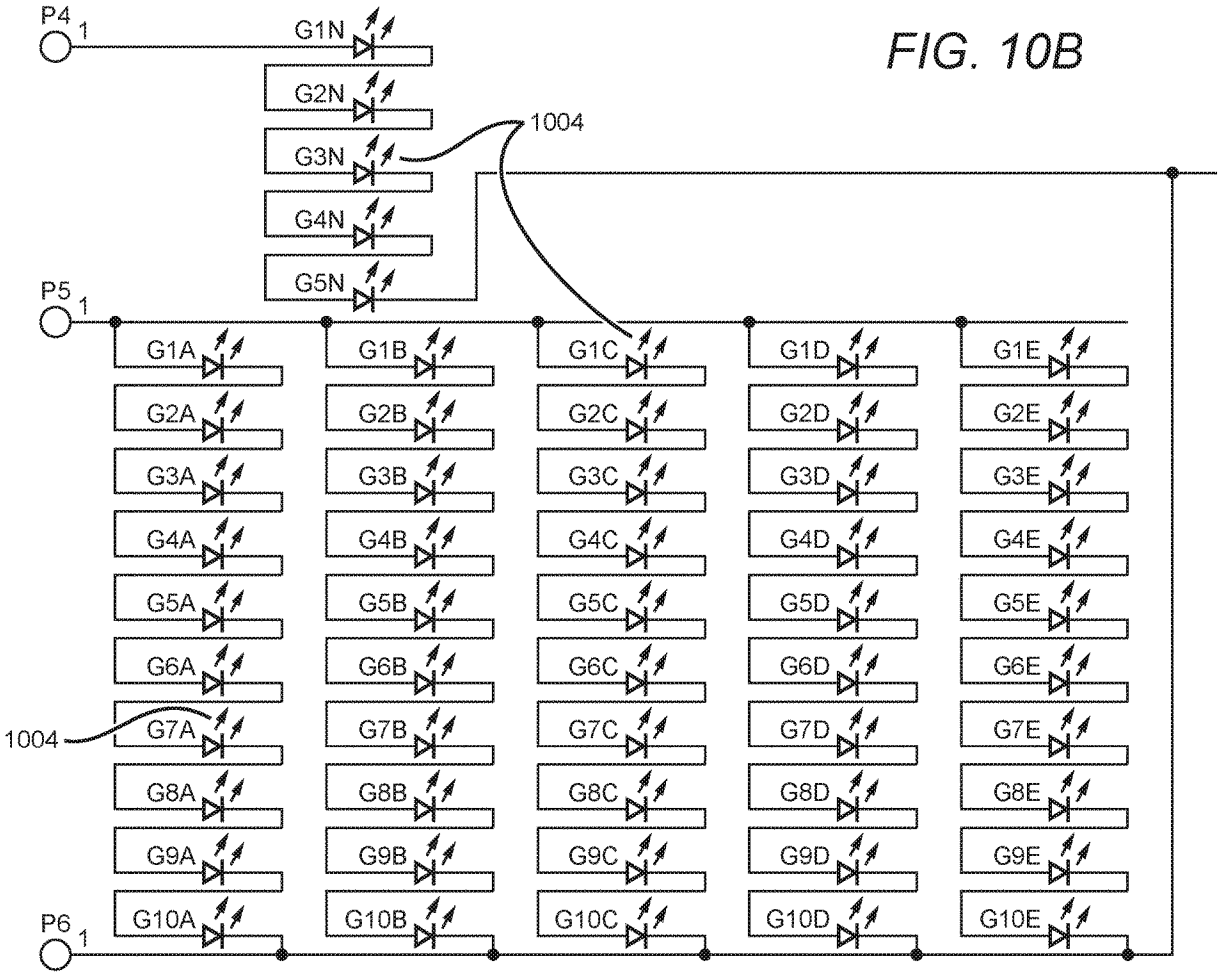

FIGS. 10A and 10B show possible circuit diagrams for the panels 900*a*,900*b*, respectively. The emitters 904 can be connected to one another using, for example, electrically conductive traces. Prior art emitter strips with strips of emitters, such as linearly aligned emitters, often have all emitters on a strip connected in series. However, the panels 900*a*,900*b* can be designed such that the emitters on a strip are not necessarily in series with one another. For example, the emitters 1004*a*,1004*b* from FIG. 10A can be in parallel with one another, which can reduce the current through each of the emitters 1004*a*,1004*b*, and can thus reduce brightness. While in this representative embodiment only two emitters 1004*a*,1004*b* are shown in parallel with one another, many different embodiments are possible, and parallel connections can include any two or more emitters 1004 on any end portion or strip.

While FIGS. 10A and 10B show possible circuit diagrams for the emitters 904 from FIG. 9, any number of parallel/series connection combinations are possible. In some embodiments, one or more outer emitters (such as, for example, the emitters on a perimeter of an array) can be brighter than one or more inner emitters (such as the emitters not on the perimeter). In another embodiment, one or more emitters at the center of the array can be dimmer. In some troffer embodiments, these arrangements can result in a more uniform fixture emission, since in some fixtures with emitters emitting at equal intensities the fixture will have a higher luminous intensity in the array center. In other embodiments, outer and/or perimeter emitters can be dimmer than central emitters. Each of the strips in a panel and/or an array can have emitters connected in different manners. Some LED circuits are described in commonly assigned U.S. patent application Ser. No. 12/566,195 to Van de Ven et al. and entitled "Color Control of Single String Light Emitting Devices Having Single String Color Control", and commonly assigned U.S. patent application Ser. No. 12/704,730 to van de Ven et al. and "Solid State Lighting Apparatus with Compensation Bypass Circuits and Methods of Operation Thereof", each of which is fully incorporated by reference herein in its entirety.

Panels according to the present invention, including but not limited to the panels 900*a*,900*b* can be connected to another portion or portions of the light engine, such as to a light engine shell similar to or the same as the light engine shell 700 from FIGS. 7A-7E. Alternatively, in embodiments comprising an internal reflector such as the internal reflector 214 from FIGS. 2A-2G, panels can also be attached to the internal reflector or to both the internal reflector and light engine shell. In embodiments where the panels are attached to a light engine shell, the panels can be directly attached to the light engine shell with no heat sink therebetween. Similarly, in embodiments where the panels are attached to an internal reflector, whether attached to both the internal reflector and the light engine shell or to just the internal reflector, the panels can be directly attached to the internal reflector with no heat sink therebetween.

Panels according to the present invention can be attached to other elements in any number and/or combination of manners. For instance, in one embodiment a connector can pass through each end attachment point (similar to or the same as the end attachment points 905 from FIG. 9) and/or strip attachment point (similar to or the same as the strip attachment points 906). Possible connectors include but are not limited to plastic, rubber, nylon, or metal screws, nails, fasteners, or dowels, although many other connectors as known in the art are possible. In one embodiment, insulation-displacement connectors ("IDC connectors") can be used. These types of connections can ensure close physical contact between the backside of a panel and the adjoining element, such as a light engine shell or reflector, which can aid in thermal dissipation. In another embodiment, panels can be attached to another element such as a light engine shell or internal reflector using an adhesive, such as a thermally conductive adhesive or putty.

Embodiments of the present invention, including those described above and below, can operate effectively without the presence of a dedicated heat sink. In certain embodiments, the backside of a light engine and/or a light engine shell can serve as the primary thermal dissipation surface, and/or a majority of the heat generated by the fixture and/or emitters can pass from the backside surface into the plenum. In certain embodiments, heat generated by a j-box does not share this heat dissipation path, as described above with regard to the j-box 140 from FIGS. 1A-1G.

Figure 11A:
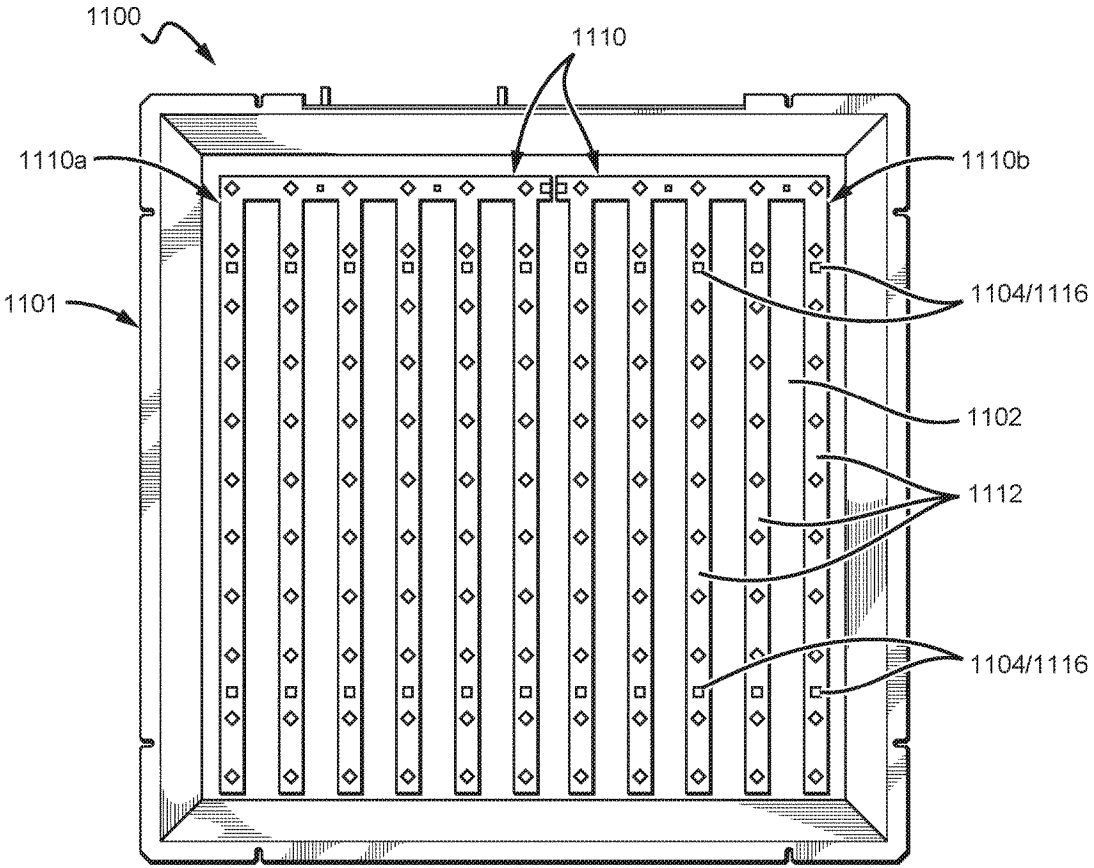
FIGS. 11A-11C are nadir and magnified perspective views, respectively, of a light engine according to an embodiment of the present invention.

FIG. 11A shows a bottom view of a light engine 1100 that can be used in embodiments of the present invention. The light engine 1100 can include a shell 1101, and may or may not include an internal reflector therein. An emitter array 1110, which can include one or more emitter panels 1110*a*, 1110*b*, can be mounted on the mount surface 1102 of the light engine 1100. The panels 1110*a*,1110*b* can optionally be shaped to form strips 1112. In the specific embodiment shown, the panel 1110*a* has six strips 1112 while the panel 1110*b* has five strips 1112, but any number of strips is possible.

Figure 11B:
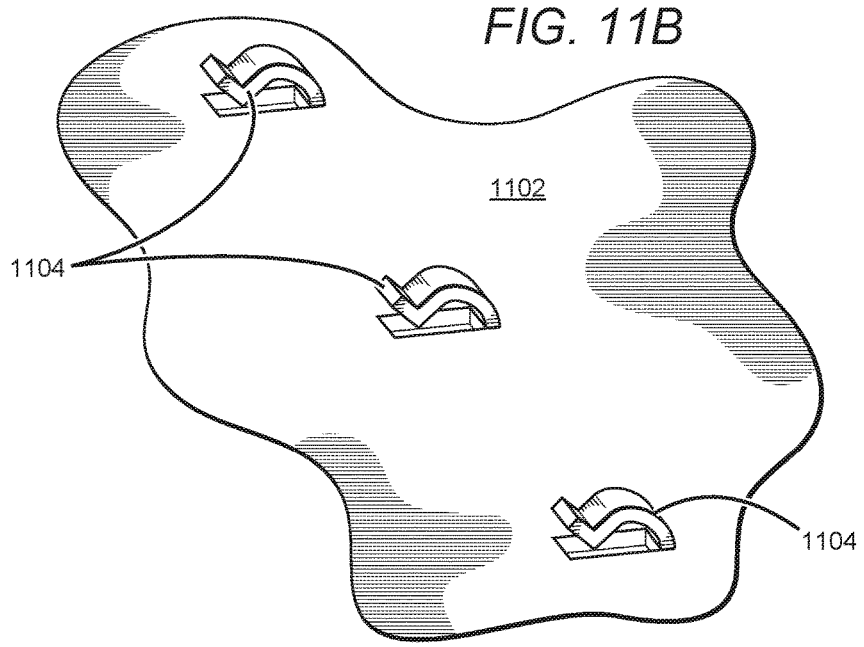
Figure 11C:
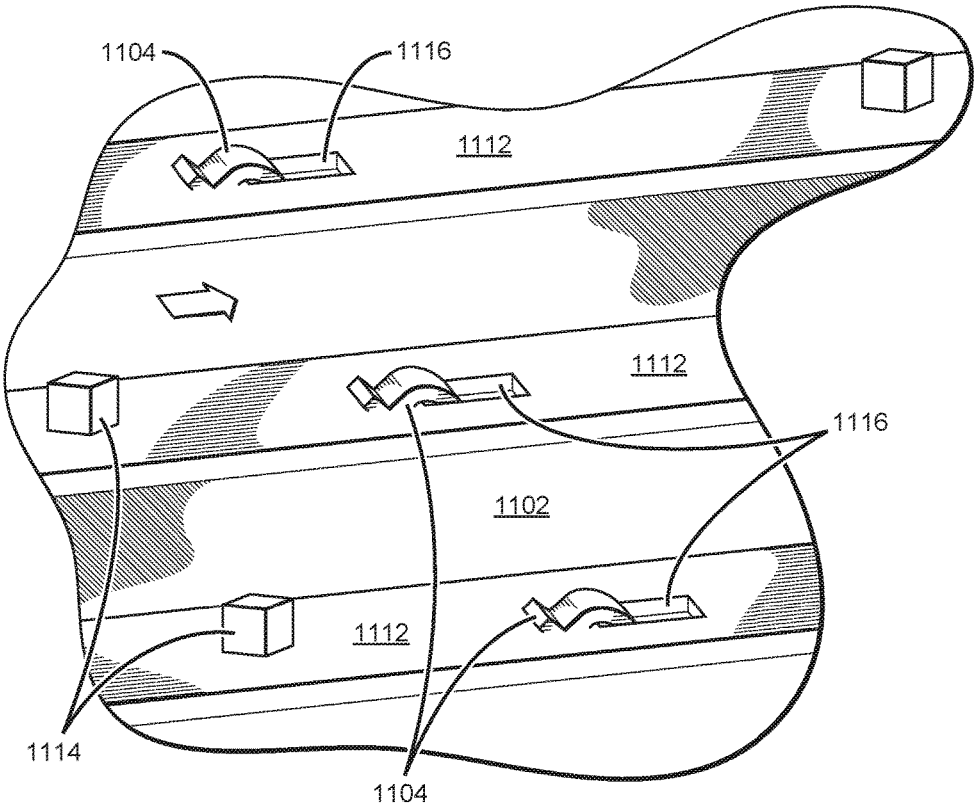

FIGS. 11B and 11C show one particular mechanism for attaching one or more emitter panels, such as the emitter panels 1110*a*,1110*b*, to a mount surface. The mount surface 1102 can be, for example, an inner surface of a light engine shell such as the light engine shell 110 from FIGS. 1A-1G, the inner surface of a reflector such as the reflector 214 from FIGS. 2A-2G, or another mount surface. FIG. 11B shows a magnified view of the mount surface 1102 before any emitter panels are mounted thereon. The mount surface 1102 can include holders 1104 which can be formed by stamping the mount surface, although other methods are possible. The holders can be somewhat elastic so as to allow for an object to be placed in between the holder and the remainder of the mount surface 1102. The holder 1104 can then press against such an object to pin it between the holder 1104 and the rest of the mount surface 1102. In such an embodiment, the object (such as a PCB panel) can be compressed between the holder and the mount surface. Each holder can be, for example, a hook or a flange, although other embodiments are possible.

FIG. 11C shows a magnified view of part of the light engine 1100 with the panels 1110*a*,1110*b* attached to the mount surface 1102. The emitter panels 1110*a*,1110*b* can include emitters 1114. In this magnified view, one attachment point 1116 is shown in each of the strips 1112; in this embodiment, the attachment points 1116 can be holes, although other attachment points are possible. Each attachment point in an emitter panel can have a corresponding holder in a mount surface. In this embodiment, the panel 1110 can be placed on the mount surface 1102 such that the holders 1104 are within the attachment points 1116 (this position is not shown in FIGS. 11A and 11B). The panel can then be slid in the direction of the arrow in FIG. 11C such that part of each of the strips 1112 is forced under part of the holders 1104, pinning the strips 1112 between the holders 1104 and the remainder of the mount surface 1102 and thus securing the array 1110 in position. In one embodiment, the panel is still removable after being compressed by holders, such as by moving the panel in a direction opposite the arrow in FIG. 11C, although in other embodiments the panels are not removable.

The embodiment described above with regard to FIGS. 11A-11C can allow for attachment of emitter panels to a mount surface without the use of dedicated connectors. Many other such embodiments are possible, such as push-pin type fasteners and other fasteners.

In one embodiment of the present invention, emitter panels are attached using a combination of the above connection mechanisms. For example, two end attachment points are attached to a mount surface using plastic or nylon screws or fasteners, while two strip attachment portions for each of 11 strips (6 on one panel and 5 on another panel) are attached using the mechanism described in FIG. 11B. While this is one specific embodiment, many different combinations of the above attachment mechanisms and methods can be used.

In any of these connection methods described above including male and female parts, the shell and/or reflector can include the male part and the panel(s) the female part, the shell and/or reflector can include the female part and the panel(s) the male part, and/or the shell and/or reflector and panel(s) can be female while a separate piece is used as the male part. Combinations of different types of connection methods and male/female parts are possible.

While the emitters shown above in FIGS. 9, 11A, and 11C are shown and described as on top of PCB, other embodiments are possible. For example, the emitters can be mounted directly on a mount surface such as the mount portion 720 from FIGS. 7A-7E, such as by an adhesive, for example, a thermally conductive adhesive or putty. In another embodiment a PCB can surround each of the emitters. These arrangements can improve thermal dissipation from the emitters and/or reduce costs. Mounting arrangements which can be used in embodiments of the present invention are described, for example, in commonly assigned U.S. patent application Ser. No. 14/145,355 to Lui et al. and entitled "Lighting Fixture with Reflector and Template PCB", which is fully incorporated by reference herein in its entirety.

Embodiments of the present invention, including but not limited to those described above and hereafter as well as embodiments incorporating the specific elements described above and hereafter, can emit about 3000 lumens or more, about 3500 lumens or more, or about 3750 lumens or more, although other embodiments with a lower or higher lumen output are possible. Embodiments have been shown to emit about 3150 lumens or more at an efficacy of about 90 lumens per watt or more. Other embodiments have been shown to emit about 3450 lumens or more at an efficacy of about 100 lumens per watt or more, and/or to emit about 3500 lumens or more at an efficacy of about 100 lumens per watt or more, and/or to emit about 3750 lumens at an efficacy of about 100 lumens per watt.

The lumen output vs. mass ratio of fixtures according to the present invention can be much higher than ratios of prior art fixtures. For example, embodiments of the present invention have been shown to emit about 800 lm/kg or more, about 900 lm/kg or more, about 1000 lm/kg or more, and in one embodiment about 1250 lm/kg or more, although embodiments can have even higher lumen per kilogram ratios.

Reflectors that can be used in embodiments of the present invention, such as the reflectors 130,230,330 from FIGS. 1A-3E, and can be many different shapes and comprise many different materials. Reflectors according to the present invention can also include stepped inner surfaces, as described in commonly assigned U.S. patent application Ser. No. 13/828,348 to Edmond et al. and entitled "Door Frame Troffer", which is fully incorporated by reference herein in its entirety.

Reflectors according to the present invention can comprise many different materials. In one embodiment of the present invention, the reflector (such as embodiments of the reflectors 130,230,330) can serve as the "backbone" of the troffer and/or can be made of a sturdier and/or heavier material than the light engine (such as embodiments of the light engines 110,210,310). For example, in one embodiment a reflector is made of aluminum and/or sheet metal that is thicker than that used in its corresponding light engine.

In one embodiment of the present invention, the reflector and/or reflective portions of the light engine (such as the inner surface 714 of the light engine shell 700 seen in FIGS. 7A-7E) can comprise a diffuse reflective surface. This can be particularly applicable to embodiments of the invention that are direct lighting troffers where emitted light is emitted in a nadir direction, since a diffuse reflective material can help increase color mixing over a specular reflector. In some embodiments of the present invention, reflective surfaces can comprise a polymeric or film material designed to reflect light emitted from an emitter on a light bar. In some embodiments the reflective surface can be white. In some embodiments the reflective surface comprises a white plastic, such as white plastic sheet(s) or one or more layers of microcellular polyethylene terephthalate ("MCPET"), and in some embodiments the reflector comprises white paper. In some embodiments reflective surfaces can comprise a white film, such as White97™ Film available from WhiteOptics, LLC, of New Castle, Del. In some embodiments reflective surfaces can comprise white powder. In other embodiments reflective surfaces can comprise metal, including but not limited to WhiteOptics™ Metal, available from WhiteOptics, LLC, or similar materials. In some embodiments, reflective surfaces can be a plastic or metal device that is coated or painted with a reflective material or another base material coated with a reflective material. Materials can also include specular reflectors which can help directly control the angle of redirected light rays, Lambertian reflectors, and combinations of diffuse, specular, and Lambertian reflectors. Some types of reflectors and/or reflective materials which can be used in embodiments of the present invention are described in U.S. patent application Ser. No. 13/828,348.

In some embodiments, texturing can be imparted to part or all of a reflector, such as to the reflector inner surface. As in the case of imprinting, polycarbonate can be used. Also as in the case of imprinting, the intensity of the roughening can vary spatially relative to the center of the reflector and/or the positioning of the light source. The roughening can be accomplished in a number of different ways, regardless of whether the reflector is initially made by extrusion or by some other method. Texturing of the reflector can provide color mixing and reduce color hot spots and reflections in light fixtures, including light fixture emitting combinations of different colors. Textured reflectors are described in detail in commonly assigned U.S. patent application Ser. No. 13/345,215 to Lu et al. and entitled "Light Fixture with Textured Reflector" which is fully incorporated by reference herein in its entirety.

As just one example of a textured reflector according to embodiments of the invention, thin extruded high reflectivity PC plates can have a pattern imprinted as part of the extrusion process, and the plates can be pressed onto an un-textured extruded PC back reflector substrate. One example of an imprinted pattern is a prismatic pattern, which can include repeated prismatic elements extending in all directions. Such a pattern can also be used in a lens material. Another example of an imprinted pattern is a cut keystone pattern. Alternatively, the entire reflector can be extruded with an imprinted pattern on the inside or bottom surface of the reflector. Either type of imprinting can be accomplished with a textured drum as part of the extrusion process. A roughening pattern can also be applied by roughening a reflector or a plate to be pressed on to a reflector substrate with sand blasting, sanding, or another roughening technology.

Fixtures according to embodiments of the present invention can comprise one or more lenses, such as the lenses 120,220,320 from FIGS. 1A-3E, respectively. Lenses can serve to provide physical protection to components within the troffer, such as LEDs. Lenses can achieve this by, for example, preventing physical damage or dust accumulation, which can negatively affect the troffer's emission efficiency, intensity, and/or profile.

Lenses can also serve to improve the uniformity of the troffer emission. Depending upon the type of emitters and the reflector used in a troffer, bright "hotspots" of light can sometimes be seen in locations corresponding to emitter locations. These hotspots are sometimes undesirable and can negatively affect emission uniformity. A lens can help to reduce the appearance of these hotspots to a viewer by spreading the light from these hotspots across a wider viewing area. In some cases the light reflected from these hotspots can be spread across the entire luminaire. Even in troffers wherein no hotspots or insubstantial hotspots are formed, a lens can help to diffuse light, broaden the troffer's emission profile, focus the troffer's emission profile, and/or create a more uniform appearance. Troffer emission patterns can also have darker areas and/or shadows, such as at the corners of the troffer. A lens can help diffuse light to lessen or eliminate these areas.

In one embodiment of the present invention, a lens is simply a substantially flat piece of transparent material, such as glass or plastic, although other materials are possible. One possible material is optical grade diffuser plastic, which can be lightweight while limiting optical losses and achieving a desirable light distribution pattern. This can substantially reduce the cost of the troffer. In other embodiments, the lens can be faceted and/or can use bumps, pips, and/or deglaring prisms to scatter light in a predictable manner. Lenses according to the present invention can include prisms such as linear prisms, and/or can include one or more films having linear and/or discrete facets that can be stacked upon one another. Prisms and facets can be formed using a number of methods, such as by rolling and/or embossing, for example.

Lenses according to the present invention can have many different optical properties. For example, the lens can be clear or can be frosted. The lens can also be diffuse. The lens could also include a wavelength conversion film for converting a wavelength of light passing through the lens. Many different embodiments are possible.

One embodiment of a lens used in a troffer according to the present invention comprises extruded acrylic with either a diffuser built into the acrylic or a diffuser film coating. Other embodiments of lenses that can be used in the present invention include diffuse lenses, which scatter all incident light. Further embodiments can comprise acrylics, PMMAs, and/or diffusing additives. Some embodiments can comprise clear acrylics. The types of lens plates described herein are only a few of the types of lenses that can be used, and are in no way intended to be limiting.

Lenses and methods that can be used in embodiments of troffers incorporating elements of the present invention are described in detail in U.S. patent application Ser. No. 13/828,348, and in commonly assigned U.S. patent application Ser. No. 13/442,311 to Lu et al. and entitled "Optical Element Including Texturing to Control Beam Width and Color Mixing", which is fully incorporated by reference herein in its entirety.

The color mixing in fixtures according to embodiments of the present invention can be achieved through a combination of mixing from the reflective surfaces (such as a reflective inner surface of a light engine and the reflector) and from diffusion due to the lens. The properties of these reflective surfaces and of the lens can be chosen to achieve a combination of sufficient color mixing and sufficient efficacy.

Figure 12A:
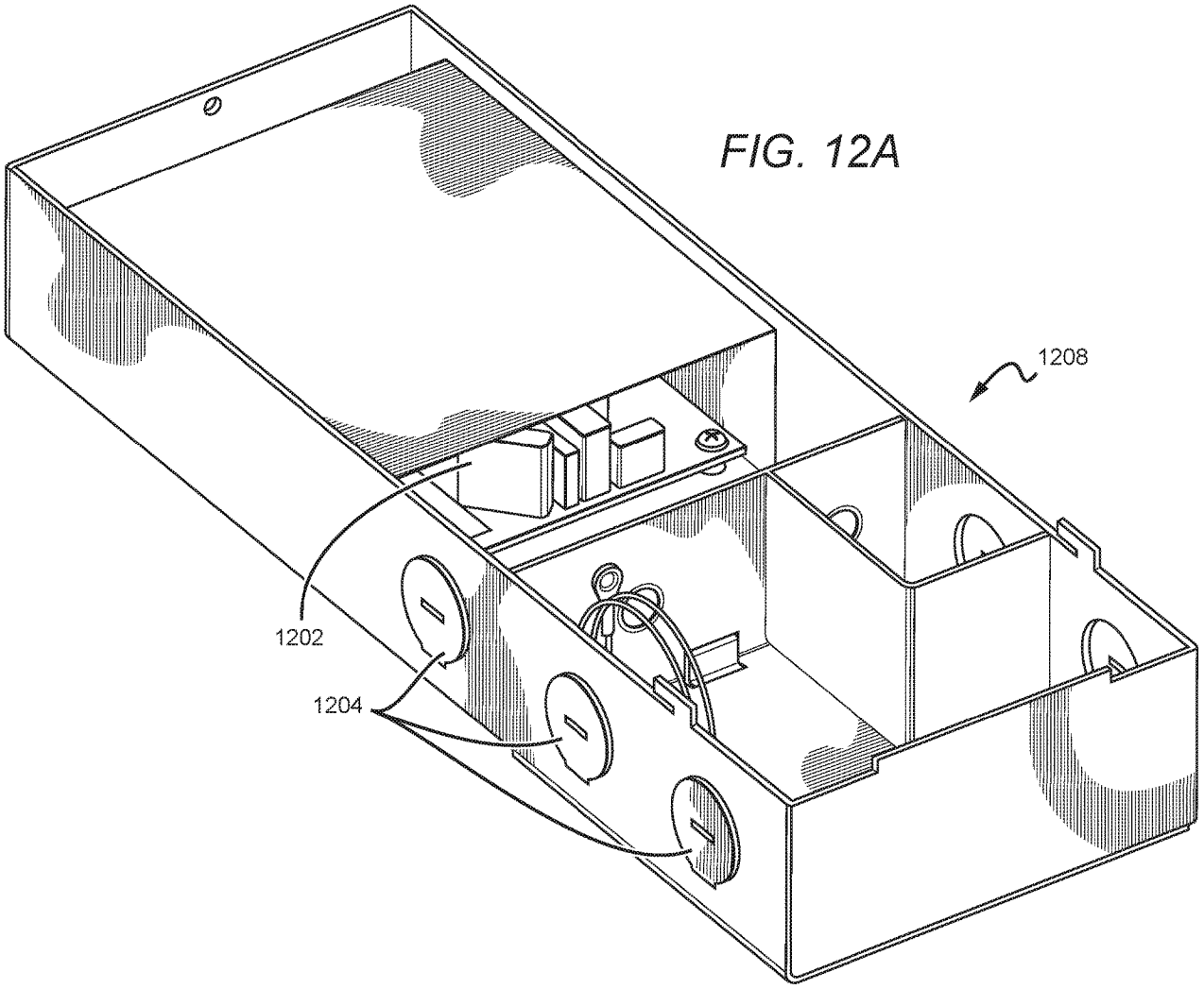
FIGS. 12A and 12B are bottom perspective and front views of a junction box according to one embodiment of the present invention.
Figure 12B:
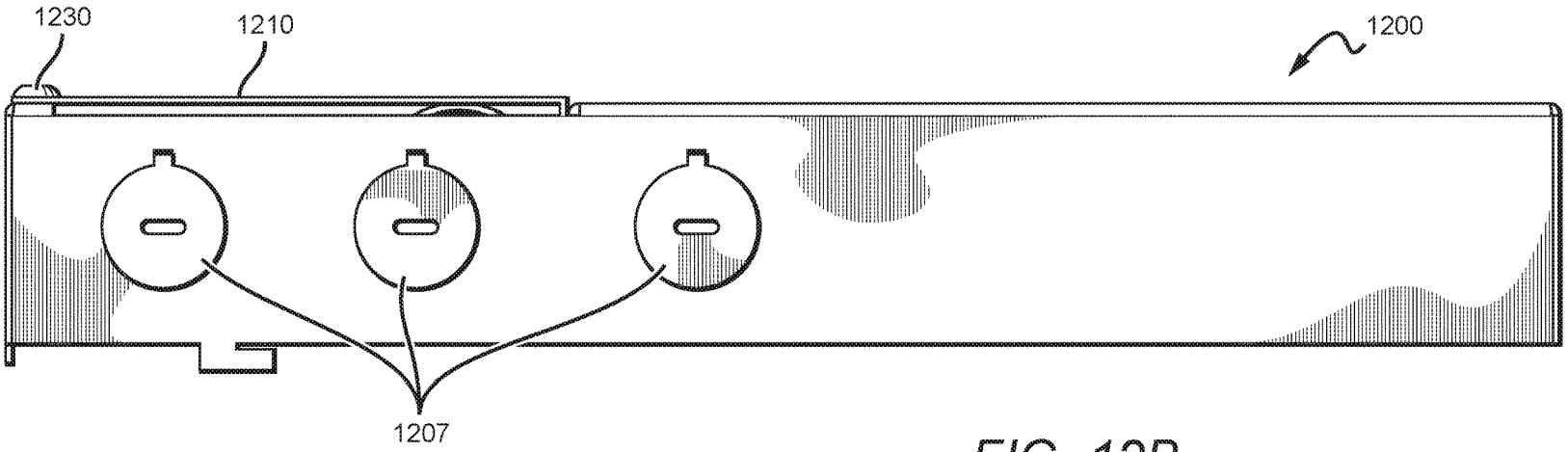

Embodiments of the present invention can also comprise an improved power supply/j-box. FIGS. 12A and 12B show bottom perspective and front views of a junction box (j-box) 1200 according to the present invention which can contain drive electronics 1202. The j-box 1200 can also include knockouts 1207, which can be stamped into the j-box 1200. The inside of the j-box can be accessed by removing a screw 1230 through the j-box's top cover 1210.

Figure 13:
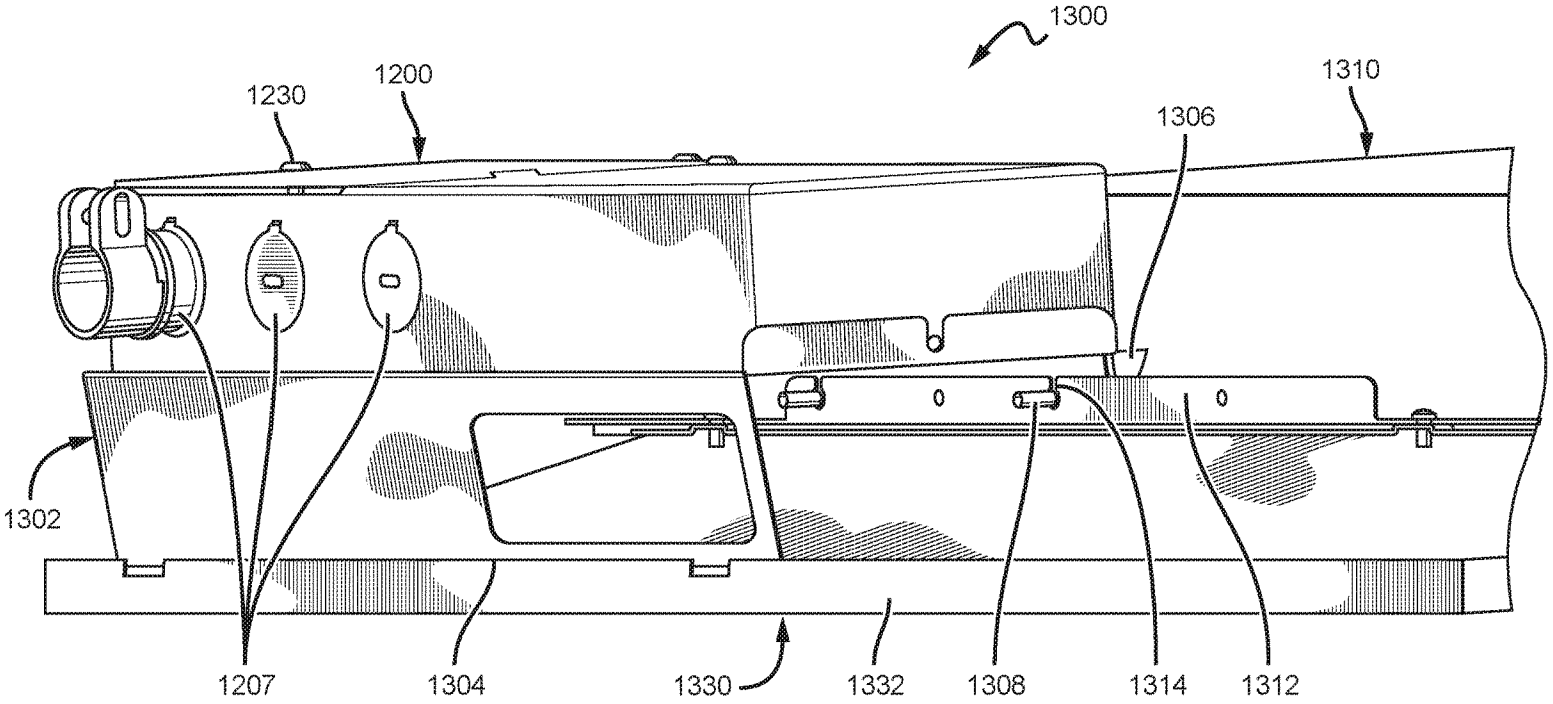
FIG. 13 is a perspective view of part of a troffer according to an embodiment of the present invention.

FIG. 13 shows a perspective view of the j-box 1200 mounted to a troffer 1300. The j-box 1200 can be attached to the troffer 1300 using a j-box stand 1302. The j-box stand can serve both to support the j-box 1200 and to serve as the bottom plate of the j-box 1200, since as can be seen in FIG. 12A the j-box 1200 need not itself comprise a bottom plate. When the j-box 1200 does not comprise a bottom plate, electrical insulation can be provided by a layer of insulating material, such as ITW Formex®, below any drive circuitry, although other materials and other embodiments are possible. The j-box stand 1302 can have a bottom connection 1304 which can be connected to a portion of a reflector 1330, such as a crimped portion 1332. The j-box stand 1302 can have an upper connection 1306 which can attach to, for example, a crimped portion 1312 of a light engine 1310. The upper connection portion 1306 can also be a separate piece, similar to the j-box support 144 from FIGS. 1A-1G. The crimped portion 1312 can be the same as or similar to the crimped portions shown in FIGS. 6A-6C above, and can also include slots 1314 into which a dowel 1308 or other connecting device of the j-box stand 1302 (or, alternatively, of the j-box 1200 itself) can fit.

Figure 14A:
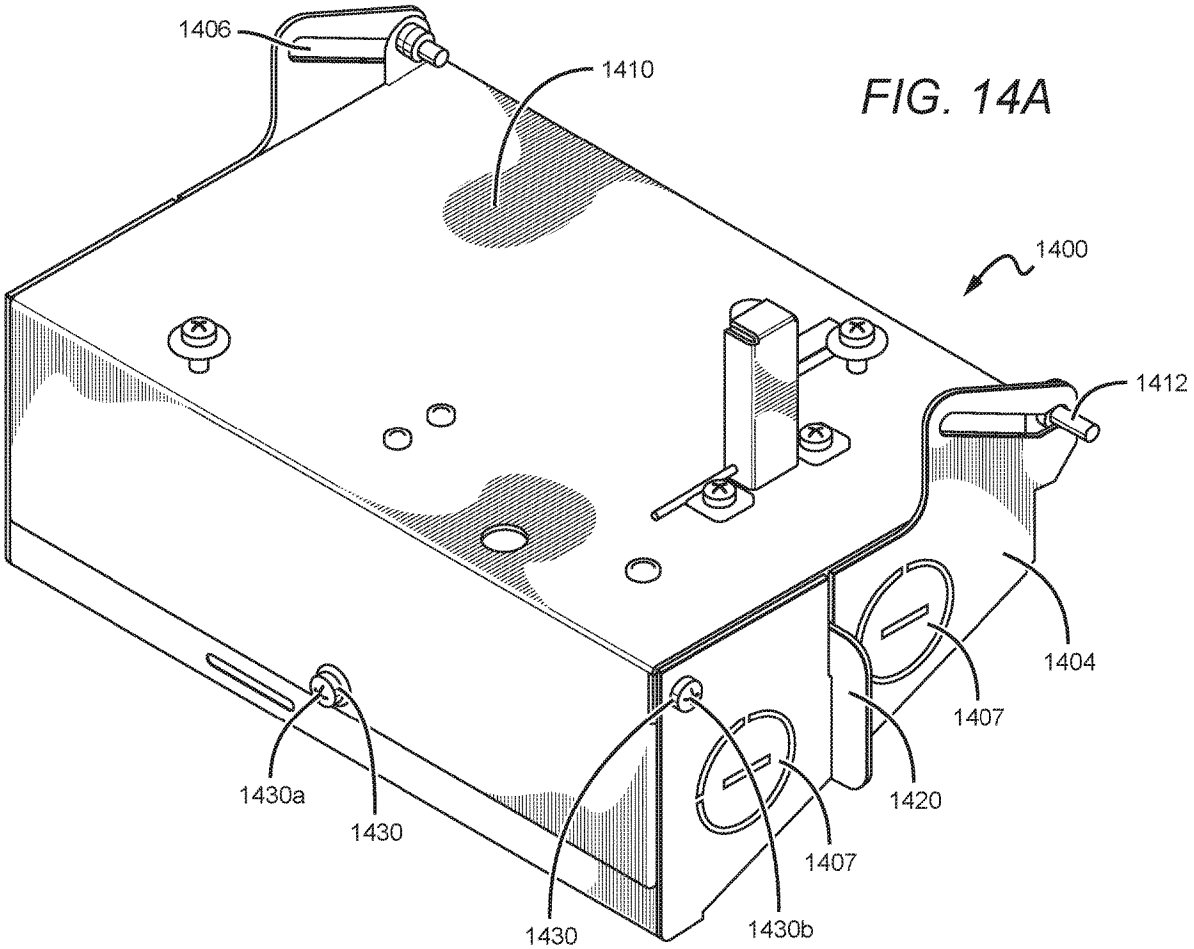
FIGS. 14A-14E are perspective, front, side, first partial perspective, and second partial perspective views of a junction box according to another embodiment of the present invention.
Figure 14B:
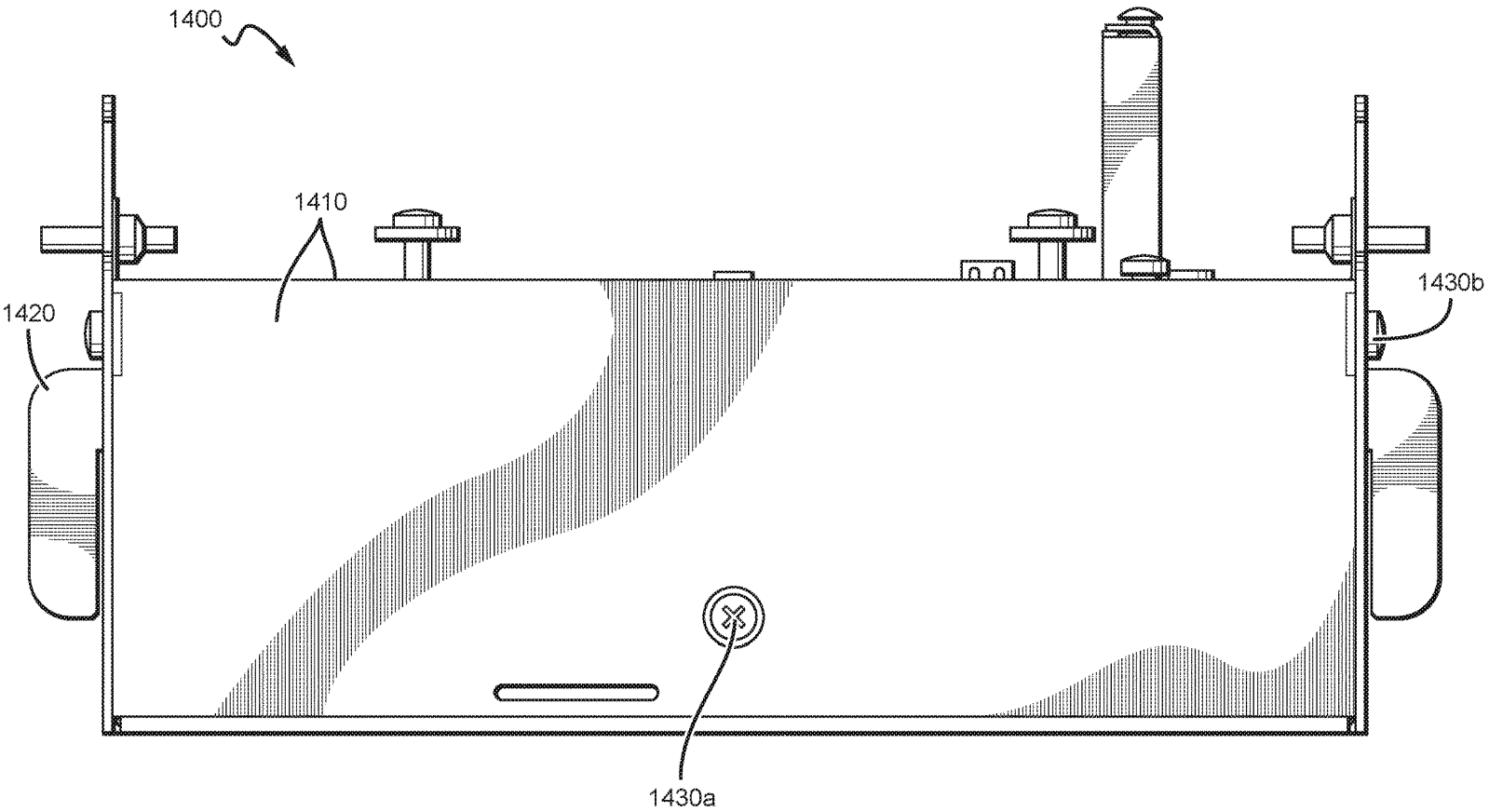
Figure 14C:
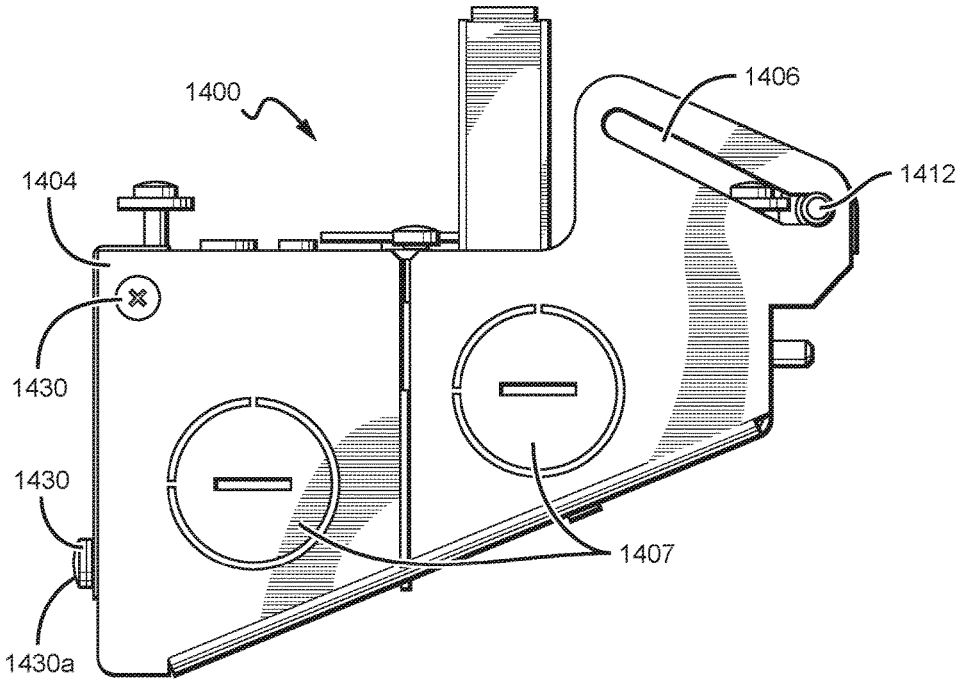

FIGS. 14A-14E show views of another j-box 1400 according to the present invention. FIGS. 14A-14C show perspective, front, and side views, respectively. The j-box 1400 can include a base 1404 and cover 1410. The j-box 1400 can include a mechanism such that the cover 1410 can be raised and/or opened. In one embodiment, the cover 1410 can be locked in an open position. In the specific embodiment shown, the j-box base 1404 can comprise one or more slots 1406 or similar features, and the cover 1410 can comprise one or more dowels 1412 or similar features to fit into the slots 1406. The dowels 1412 can be movable within the slots 1406. Junction boxes according to the present invention can also comprise a separator such as the separator 1420, which will be discussed in detail below.

The j-box 1400 can include locking mechanisms 1430 for locking the j-box 1400 in a closed position. In one embodiment, three screws can be used to lock the j-box 1400 in a closed position. One screw can be positioned on the front of the j-box, while two others are located on the sides. Alternatively, in one embodiment, a single locking mechanism 1430*a* is used to lock the j-box 1400 in a closed position. In another embodiment, a j-box does not contain a front locking mechanism such as the locking mechanism 1430*a*, but instead only includes two side locking mechanisms such as the locking mechanisms 1430*b*.

Figure 14D:
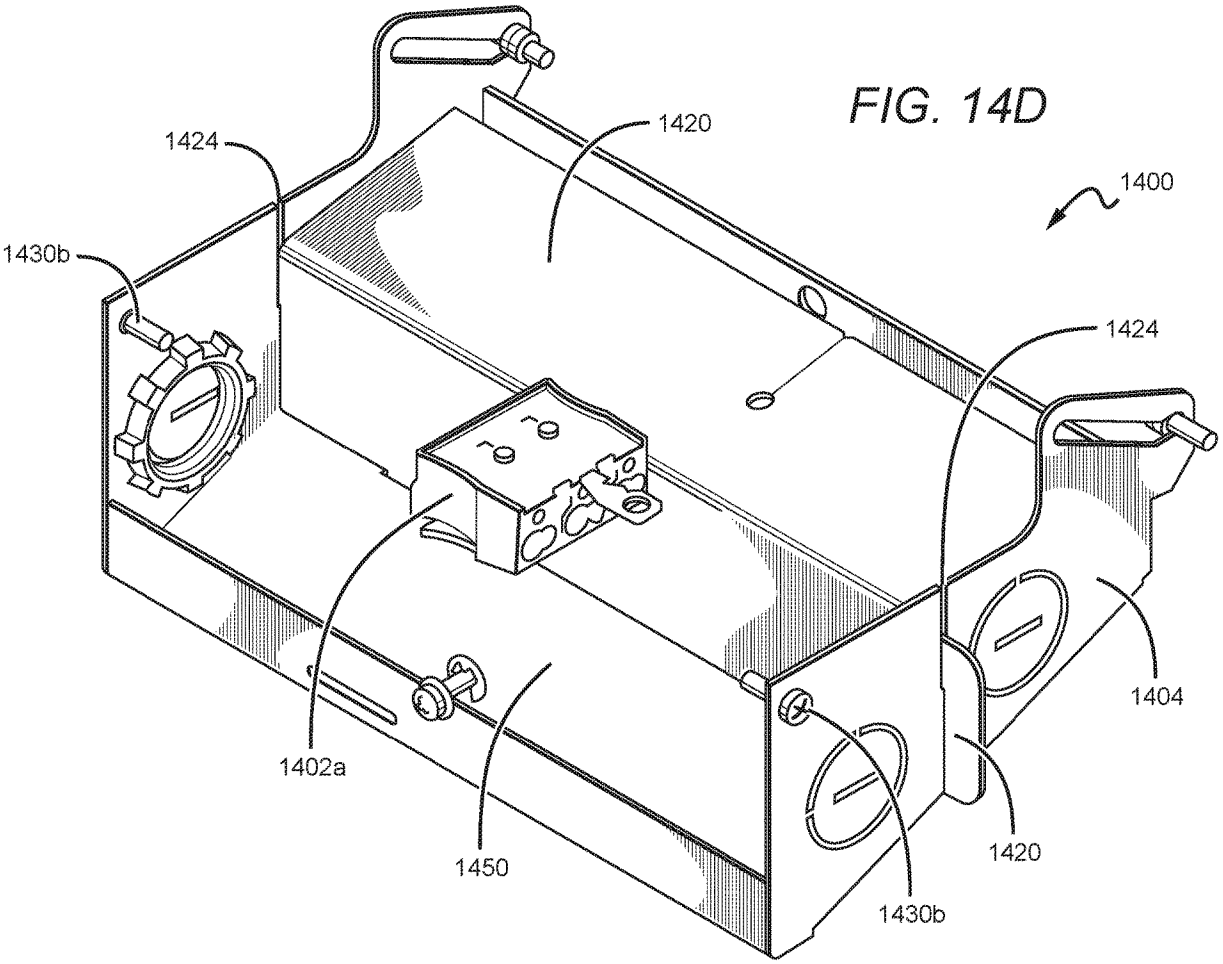
Figure 14E:
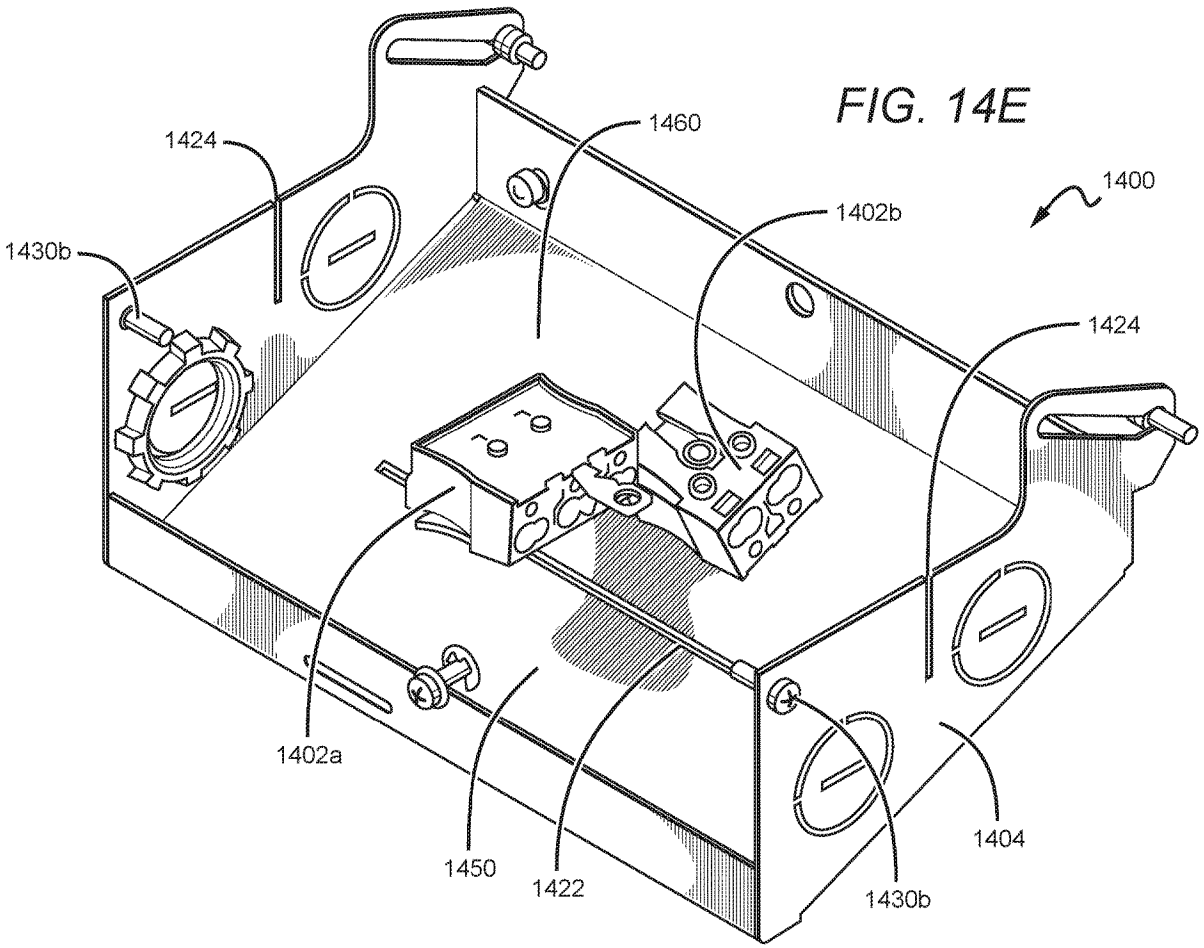

FIG. 14D shows a view of the j-box 1400 with the cover 1410 removed. The separator 1420 can be included for compliance issues and so that wires can be handled more easily. As best seen in FIG. 14E, drive electronics 1402*a* can be included in a first section 1450 of the j-box 1400. In this view the drive electronics 1402*a* are shown as floating, since in this specific embodiment the drive electronics 1402*a* are attached to the cover 1410, which is not shown. The separator 1420 can fit into one or more slots 1422,1424 (seen best in FIG. 14E). While the separator 1420 is shown as a separate removable component, in other embodiments it can be integral with the base 1404 or the cover 1410.

FIG. 14E shows a view of the j-box 1400 with both the cover 1410 and the separator 1420 removed. The j-box can include the first section 1450 with drive electronics 1402*a* and a second section with drive electronics 1402*b*. Each of the drive electronics 1402*a*,1402*b* can be mounted to either the base 1404 or the cover 1410 (in the embodiment shown, the drive electronics 1402*a* are mounted to the cover 1410 while the drive electronics 1402*b* are mounted to the base 1404). The drive electronics 1402*a*,1402*b* can control different aspects of the emission from a troffer. For instance, the electronics 1402*a* could control dimming while the electronics 1402*b* control an AC signal, or vice versa. Further, it is understood that while the j-box 1400 includes two sections 1450,1460 and two sets of driver electronics 1402*a*,1402*b*, j-boxes according to the invention can include one section or three or more sections and any number of different drive electronic sets, and one or more separators can run in any direction to carve out these sections.

Figure 15A:
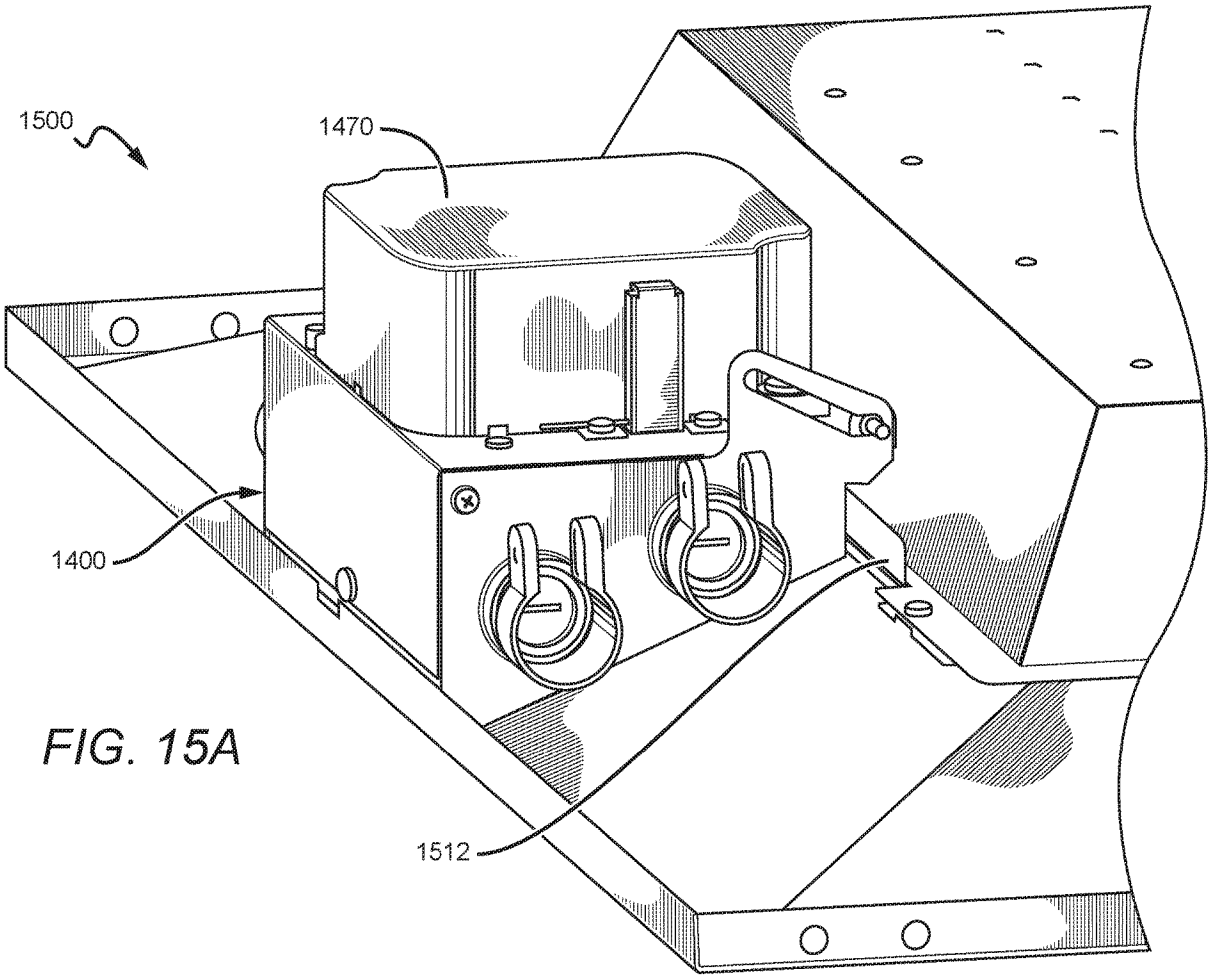
FIGS. 15A and 15B are perspective and side views of part of a troffer according to another embodiment of the present invention.
Figure 15B:
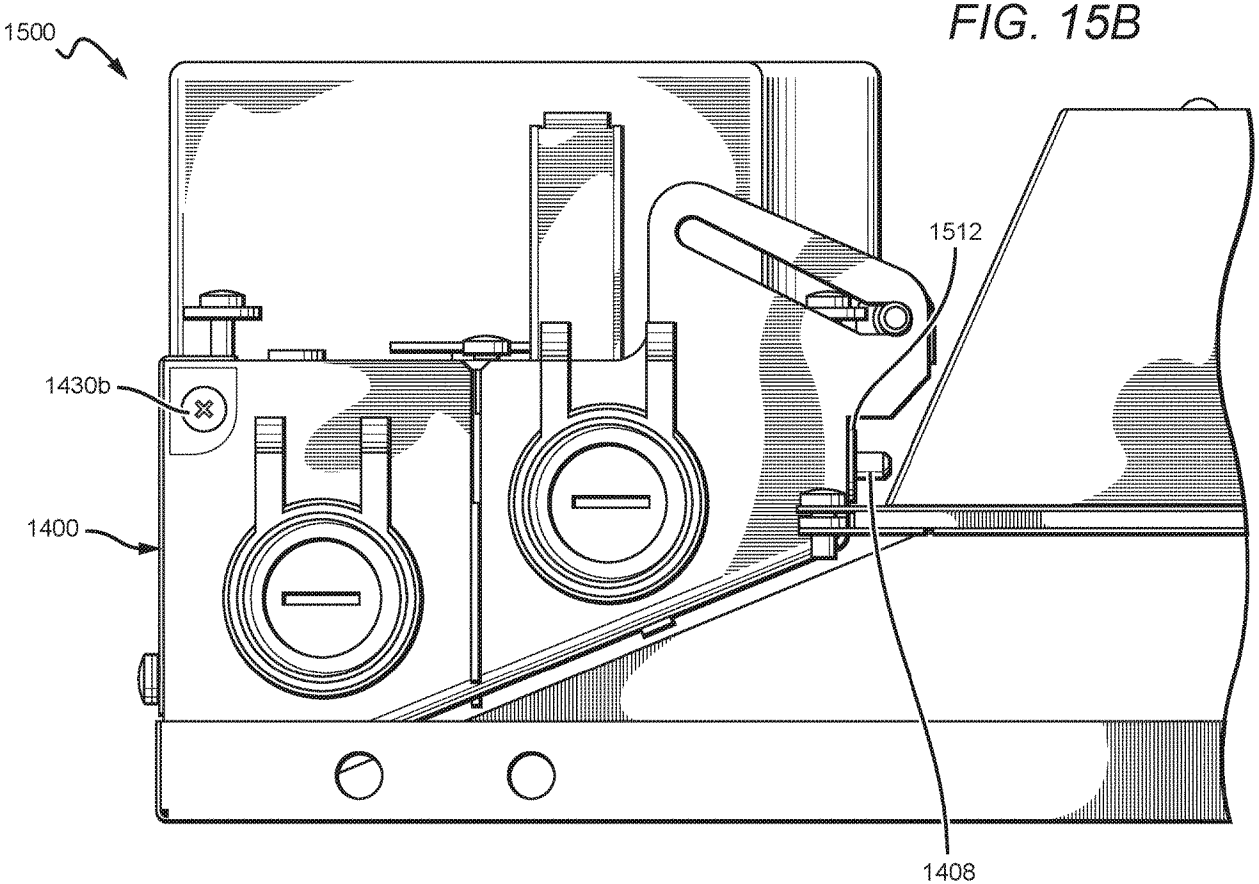
Figure 15C:
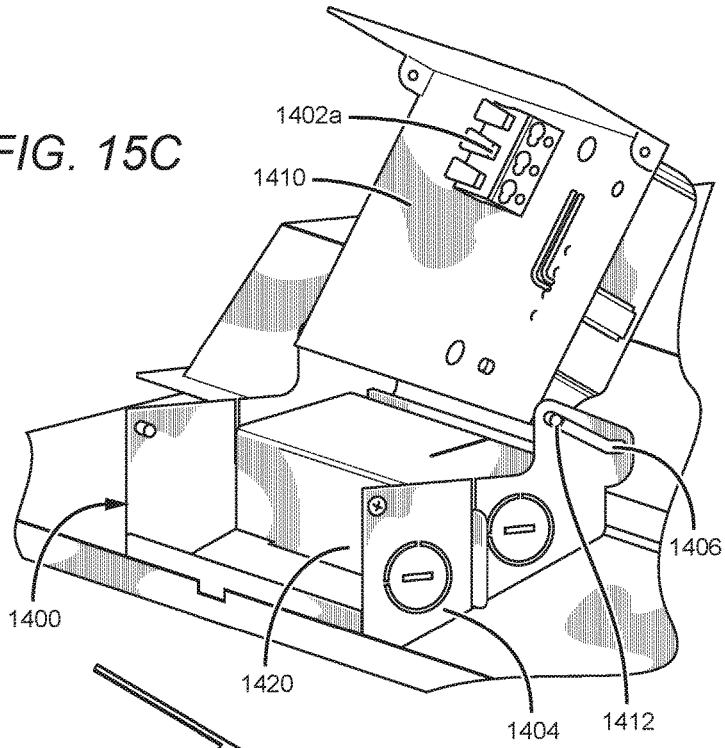
FIGS. 15C and 15D are alternate perspective and side views of part of the troffer from FIGS. 15A and 15B.
Figure 15D:
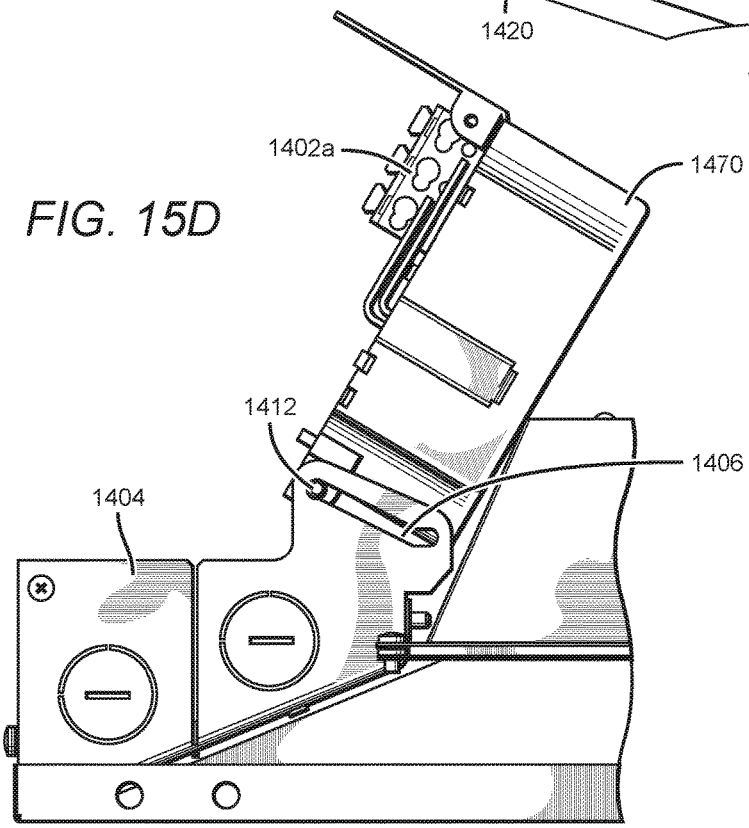

FIGS. 15A and 15B show perspective and side views of the j-box 1400 mounted to a troffer 1500, and FIGS. 15C and 15D show perspective and side views with the cover 1410 in an open position. The j-box 1400 can be mounted to the troffer 1500 in a manner similar to the j-box 1200 and the troffer 1300 from FIG. 13. For instance, a crimped portion 1512 of the troffer 1500 can include one or more slots into which one or more connecting pieces 1408, such as dowels, can fit. The dowels can be part of the j-box base 1404 or cover 1410, although other embodiments are possible.

As best seen in FIGS. 15C and 15D, the j-box can be opened with the cover 1410 remaining attached to the remainder of the j-box 1400. This movement can be enabled by removing or unlocking a locking mechanism, such as the locking mechanisms 1430. The cover 1410 can be hinged. For example, the dowels 1412 can act as a hinge to allow for rotation of the cover 1410. In the specific embodiment shown, the dowels 1412 can form a movable hinge, as the dowels 1412 can move to an opposite end of the slots 1406 than from when the cover 1410 is in a closed position, thus raising the cover 1410 and allowing access to the inside of the j-box 1400. In other embodiments, the hinge is not movable.

The j-box can optionally include a thermostat holder 1470, which can contain a thermostat that can cut power upon overheating and/or restore power once the drive circuitry has returned to an acceptable temperature.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A lighting fixture, comprising:

a light engine comprising a first portion having an inner surface and one or more integral sidewalls defining a cavity and a light engine bottom rim along at least part of an outer perimeter of said one or more integral sidewalls, said bottom rim comprising an inner bottom rim perimeter and an outer bottom rim perimeter;

a reflector external to said cavity and defining a reflector top rim comprising an inner top rim perimeter and an outer top rim perimeter, said reflector substantially below said light engine bottom rim;

a lens at least partially between said light engine bottom rim and said reflector top rim, wherein said lens is at least partially outside a perimeter of said light engine first portion and said inner top rim perimeter, and wherein said lens is entirely inside said bottom rim outer perimeter and said top rim outer perimeter;

wherein a planar backside surface of the light engine is exposed and is a primary thermal dissipation surface of said light fixture such that a majority of heat generated by the light engine can pass from the exposed backside surface out of the lighting fixture; and a junction box on a side surface of said lighting fixture.

2. The lighting fixture of claim 1, wherein said lens is solid and substantially flat.

3. The lighting fixture of claim 1, wherein said lens comprises an outer edge; and wherein at least a portion of one of said rims is crimped over said lens outer edge.

4. The lighting fixture of claim 3, wherein said crimped portion is on the other of said rims.

5. The lighting fixture of claim 3, comprising at least one crimped portion on each side of said fixture.

6. The lighting fixture of claim 1, wherein said lens is clamped between said rims.

7. The lighting fixture of claim 6, further comprising a connector between said rims.

8. The lighting fixture of claim 7, wherein said connector compresses said lens between said rims.

9. The lighting fixture of claim 7, wherein said connector is adjacent said lens.

10. The lighting fixture of 7, wherein said connector is on an outer edge of said lens.

11. The lighting fixture of claim 7, comprising a connector on each side of said fixture and between said rims;

wherein said lens is secured by said connectors.

12. The lighting fixture of claim 1, wherein said light engine has a trapezoidal cross-section.

13. The lighting fixture of claim 12, wherein said reflector has a trapezoidal cross-section.

14. The lighting fixture of claim 1, wherein said reflector has a trapezoidal cross-section.

15. The lighting fixture of claim 1, wherein said lighting fixture lacks a distinct heat sink.

16. The lighting fixture of claim 1, wherein said junction box is on a side surface of said reflector.

17. The lighting fixture of claim 1, wherein said junction box is on a side surface of said light engine.

18. The lighting fixture of claim 1, wherein said junction box is on a side surface of both said light engine and said reflector.

19. The lighting fixture of claim 1, wherein said light engine comprises a shell made of sheet metal.

20. The lighting engine of claim 19, wherein said shell comprises said planar backside surface.

21. The lighting fixture of claim 19, wherein said reflector is made of sheet metal.

22. The lighting fixture of claim 1, wherein said reflector is made of sheet metal.

23. The lighting fixture of claim 1, wherein said reflector comprises one or more integral sidewalls, and wherein the one or more sidewalls of said reflector are flatter than the one or more integral sidewalls of said light engine.

24. A method of manufacturing a lighting fixture, said method comprising:

providing a light engine comprising an inner surface, one or more integral sidewalls, and a first rim along part of an outer perimeter of said sidewalls, said first rim comprising an am inner first rim perimeter and an outer first rim perimeter, providing a reflector comprising a second rim having an inner second rim perimeter and an outer second rim perimeter, said reflector being external to said light engine;

securing a lens between said first rim and said second rim wherein a portion of said lens is outside said inner first rim perimeter and said inner second rim perimeter and wherein said lens is entirely inside said outer first rim perimeter and said outer second rim perimeter, wherein said securing comprises bending at least one of said rims at least partially around an edge of said lens; and configuring the lighting fixture such that a planar backside surface of the light engine is exposed and is a primary thermal dissipation surface such that a majority of heat generated by the light engine can pass from the backside surface out of the lighting fixture.

25. The method of claim 24, wherein each of said one or more connectors is passed through said rims.

26. The method of claim 25, wherein each of said one or more connectors is outside a perimeter of said lens.

27. The method of claim 25, wherein said applying comprises passing said one or more connectors through said rims;

wherein said lens is laterally secured by said one or more connectors.

* * * * *